US011319685B2

(12) United States Patent
Abeles

(10) Patent No.: US 11,319,685 B2
(45) **Date of Patent: *May 3, 2022**

(54) PORTABLE WATER INFLATABLE BARRIER WITH ANCHORING SUPPORT BASE

(71) Applicant: Gary E. Abeles, Verona, NJ (US)

(72) Inventor: Gary E. Abeles, Verona, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/008,980

(22) Filed: Sep. 1, 2020

(65) Prior Publication Data

US 2020/0399846 A1 Dec. 24, 2020

Related U.S. Application Data

(63) Continuation-in-part of application No. 16/525,872, filed on Jul. 30, 2019, now Pat. No. 10,767,329, which is a continuation-in-part of application No. 16/016,874, filed on Jun. 25, 2018, now Pat. No. 10,400,408, which is a continuation-in-part of application No. 15/630,457, filed on Jun. 22, 2017, now Pat. No. 10,036,134, which is a continuation-in-part of application No. 15/382,965, filed on Dec. 19, 2016, now Pat. No. 9,719,225, which is a continuation-in-part of application No.

(Continued)

(51) Int. Cl.

| | |
|---|---|
| ***E02B 3/10*** | (2006.01) |
| ***E02B 7/00*** | (2006.01) |
| ***E02B 3/12*** | (2006.01) |

(52) U.S. Cl.

CPC ..... *E02B 3/108* (2013.01); *E02B 3/127* (2013.01); *E02B 7/005* (2013.01)

(58) Field of Classification Search

CPC . E02B 3/10; E02B 3/106; E02B 3/108; E02B 3/127; E02B 7/005

USPC ..... 405/111, 114, 115

See application file for complete search history.

(56) References Cited

U.S. PATENT DOCUMENTS 4,692,060 A * 9/1987 Jackson, III ..... E02B 3/108 405/115
6,551,025 B2 * 4/2003 Dery ..... E02B 3/108 405/115

(Continued)

FOREIGN PATENT DOCUMENTS

DE 102007010579 * 8/2008
FR 2860251 A1 * 4/2005 ..... E02B 3/108

*Primary Examiner* — Frederick L Lagman

(74) *Attorney, Agent, or Firm* — Maine Cernota & Rardin

(57) ABSTRACT

A portable, water-filled barrier system includes a water-fillable module that is internally divided into cells that emulate a section of a sandbag dike or wall, the module being supported by a hollow frame including a base below the module and a rear wall behind the module. Holes allow flood water to enter the frame's interior. A peripheral base rim can surround and restrain the module. At least one brace can extend from behind the rear wall of the frame to underlying terrain, where it can be wedged or staked in place. The frame can be unitary or can comprise separate base and rear wall constructions that can be assembled to form the frame, for example by inserting a portion of one into a trough provided in the other. A fitting can extend between the assembled base and rear wall to allow water to flow between the hollow interiors.

16 Claims, 27 Drawing Sheets

Related U.S. Application Data

15/016,606, filed on Feb. 5, 2016, now Pat. No. 9,556,574, which is a continuation of application No. 14/594,407, filed on Jan. 12, 2015, now Pat. No. 9,334,616, which is a continuation-in-part of application No. 13/663,756, filed on Oct. 30, 2012, now Pat. No. 8,956,077.

(60) Provisional application No. 61/553,403, filed on Oct. 31, 2011.

(56) References Cited

U.S. PATENT DOCUMENTS 6,641,329 B1 * 11/2003 Clement ..... E02B 3/108 405/115
7,214,005 B1 * 5/2007 Davis ..... E02B 3/102 405/114
8,956,077 B2 * 2/2015 Abeles ..... E02B 3/108 405/111
9,334,616 B2 * 5/2016 Abeles ..... E02B 3/108
9,556,574 B2 * 1/2017 Abeles ..... E02B 3/127
9,719,225 B2 * 8/2017 Abeles ..... E02B 7/005
10,036,134 B2 * 7/2018 Abeles ..... E02B 3/108
10,400,408 B2 * 9/2019 Abeles ..... E02B 3/108
10,767,329 B2 * 9/2020 Abeles ..... E02B 3/127
2004/0047688 A1 * 3/2004 Clement ..... E02B 3/108 405/115
2005/0260038 A1 * 11/2005 Sousa Costa ..... E02B 3/108 405/115
2006/0099033 A1 * 5/2006 Boraggina ..... E02B 3/108 405/107
2007/0237586 A1 * 10/2007 Prestininzi ..... E02B 3/127 405/115
2009/0064598 A1 * 3/2009 Mouyiaris ..... E02B 3/108 52/2.11
2009/0274519 A1 * 11/2009 Shaw ..... E02B 3/108 405/107
2010/0284747 A1 * 11/2010 Peterson ..... E02B 3/108 405/114
2014/0010601 A1 * 1/2014 Bradley, Sr ..... E02B 3/108 405/302.7
2016/0319504 A1 * 11/2016 Vickers ..... E02B 3/10
2019/0382974 A1 * 12/2019 Abeles ..... E02B 3/06

* cited by examiner

PORTABLE WATER INFLATABLE BARRIER WITH ANCHORING SUPPORT BASE

RELATED APPLICATIONS

This application is a continuation in part of application Ser. No. 16/525,872, filed on Jul. 30, 2019, now U.S. Pat. No. 10,767,329. Application Ser. No. 16/525,872 is a continuation in part of application Ser. No. 16/016,874, filed on Jun. 25, 2018, now U.S. Pat. No. 10,400,408. Application Ser. No. 16/016874 is a continuation in part of application Ser. No. 15/630,457, filed on Jun. 22, 2017, now U.S. Pat. No. 10,036,134. Application Ser. No. 15/630,457 is a continuation in part of application Ser. No. 15/382,965, filed on Dec. 19, 2016, now U.S. Pat. No. 9,719,225. Application Ser. No. 15/382,965 is a continuation in part of application Ser. No. 15/016,606, filed on Feb. 5, 2016, now U.S. Pat. No. 9,556,574. Application Ser. No. 15/016,606 is a continuation of application Ser. No. 14/594,407, filed on Jan. 12, 2015, now U.S. Pat. No. 9,334,616. Application Ser. No. 14/594,407 is a continuation in part of application Ser. No. 13/663,756, filed on Oct. 30, 2012, now U.S. Pat. No. 8,956,077. Application Ser. No. 13/663,756 claims the benefit of U.S. Provisional Application No. 61/553,403, filed Oct. 31, 2011. All of these applications are herein incorporated by reference in their entirety for all purposes.

FIELD OF THE INVENTION

The invention relates to temporary barriers, such as dikes used for flood control, and more particularly, to water-filled portable barriers.

BACKGROUND OF THE INVENTION

Circumstances sometimes arise where a temporary dike, wall, or other barrier is needed to prevent a flood, landslide, or other threat from spreading and threatening lives and property. Often, such a temporary barrier is constructed from sandbags, whereby empty bags and a quantity of dirt or sand are brought to the site, and a crew of workers fills the bags with the dirt or sand and stacks the bags to form the barrier. With reference to FIG. 1, the bags are often stacked so as to form a barrier with a "pyramid" cross-section 100 that is widest at the base, and narrower at the top.

In some cases, the weight of the sand in the barrier 100 is sufficient to hold the barrier 100 in place during the flood or other threat. With reference to FIG. 2, in other cases a shallow trench 200 is prepared first, the trench having a depth that is approximately equal to the thickness of one sandbag. One or two rows of sandbags 202 are laid in the trench 200, with the remainder of the barrier 100 being constructed on top of the initial one or two rows 202. In this way, friction between the sandbags in the trench and the remainder of the sandbags further helps to hold the barrier in place.

A sandbag barrier is generally effective and the materials are relatively inexpensive. Furthermore, a sandbag barrier is easily adapted to extend between arbitrary locations, even if a curved, angled, or otherwise shaped barrier is required. However, there can be significant costs and construction time associated with a sandbag dike, due to the requirement to bring the sand or dirt to the construction site, which may weigh many tons, and due to the need to employ significant labor to fill and stack the bags.

In addition, after the flood or other threat has subsided, disposal of the sandbags can be time consuming and costly, especially if the sand and bags have become wet and contaminated by flood water and require special disposal procedures to avoid risks to health and to the environment.

What is needed, therefore, is a portable dike, wall, or other barrier that can withstand and contain the pressure of flood waters in a manner at least as effective as a sandbag dike or wall, but does not require delivery of large quantities of heavy materials to the construction site, does not require large amounts of labor to assemble, and is simple and inexpensive to remove when it is no longer needed.

SUMMARY OF THE INVENTION

A portable, modular, water-inflatable barrier system includes at least one barrier module that has an internal structure similar to a sandbag dike or wall, and functions in a similar manner, but does not require delivery of large quantities of heavy materials to the construction site, does not require large amounts of labor to assemble, and is simple and inexpensive to remove when no longer needed. The barrier comprises a plurality of interconnected, water-inflatable modules, each of which is made of a light, flexible material such as a heavy plastic or nanofiber. The modules can be transported to the construction site in a deflated state, after which they can be positioned, interconnected, and filled with locally available water. In embodiments, each module weighs less than 250 pounds, such that they can be lifted and carried without heavy machinery.

Each module of the barrier is a single unit that includes shaping and internal partitions which create an overall structure similar to a pile of sandbags in a sandbag wall. The interiors of the barrier modules are divided into pluralities of cells. Passages between the tops and bottoms of the cells in each module allow each of the modules to be filled from a single water inlet. Embodiments include a manifold that allows an entire assembly of modules to be simultaneously filled from a single water inlet.

In some embodiments, the cells in each module include passive automatic valves that seal the passages between the cells after the cells are filled with water, so that deflation of one cell in a module due to a puncture or some other cause will not cause the cells beneath it to deflate. In some embodiments, the outer shells of the barrier modules are made of a material that is thicker than the interior dividing walls, such as thick plastic, a synthetic rubber, or a thick layer of nanofiber, so as to better resist puncture by an external threat. In similar embodiments, the outer shells are double-walled, so that puncture of the outer wall does not affect the internal cells, so long as the inner wall remains intact. In certain embodiments the walls are coated with a protective material such as Tyvek or liquid rubber that will seal punctures if they occur.

In embodiments, the barrier modules can be initially inflated with air, so that they can be easily positioned and interconnected. The barrier modules can then be filled with water, while the displaced air is released through a pressure valve at the top of the barrier. In some of these embodiments, pre-inflation of the barrier modules with air allows interlocking barrier modules to be easily placed in their interlocking configuration before the air within the barrier modules is replaced by water.

The internal structures of the barrier modules enable them to maintain their shape when the barrier is subjected to externally applied horizontal forces, such as pressure from flood waters. In some embodiments, the shape of the structure is made even more rigid by the inclusion within the cells of stiff, lightweight rods or plates made of plastic, bamboo, or a similar material.

In addition to maintaining their shapes and resisting punctures while in use, barrier modules must also resist horizontal displacement due to horizontal pressure from flood waters and due to impacts by floating objects that are carried by the flood waters. It is notable that displacement of a module even by a small amount relative to its neighbors can lead to leakage of water between the modules. This problem can be especially problematic for trapezoidal or wedge-shaped modules that serve to change the direction of a barrier, because even a slight displacement of such a wedge-shaped or trapezoidal module can open up a gap between the module and neighboring modules, thereby creating an opportunity for water to leak therebetween.

By themselves, the barrier modules are resistant to horizontal displacement due to friction between their bases and the underlying ground surface, as well as due to friction between adjoining modules. This can be enhanced, for example by providing a high-friction surface on the bottoms of the modules, and/or by providing an underlying sheet that can be installed between the modules and the ground. In embodiments, the underlying sheet can be folded over the front of the barrier, thereby providing additional protection against strikes from floating objects.

In embodiments, barrier modules can be attached to each other, for example by straps that interconnect between loops provided on the sides of the modules. Such attachment can provide additional resistance to horizontal displacement of modules relative to each other. In further embodiments, additional cells extend below the bases of the inflatable barrier modules, so that they can be placed in a trench prepared at the construction site, thereby further resisting horizontal dislodgement of the barrier by flood waters or other forces. In some embodiments, the barrier modules have interlocking ends that provide structural cooperation and a water-tight seal between adjacent barrier modules.

Embodiments of the present invention include an anchoring sheet that extends flat against the ground in front of the barrier, so that the weight of the water in front of the barrier presses the anchoring sheet against the ground and creates a high frictional resistance to movement, thereby anchoring the barrier in place. In some embodiments, the anchoring sheet can be folded over the water-facing surface of the barrier so as to prevent water from leaking between the modules. In some of these embodiments, the anchoring sheet is made from a material that naturally clings to the water-facing surface of the barrier due to static electrical attraction. In embodiments, the narrow end of a triangular or trapezoid shaped anchoring sheet can be placed beneath the narrow front of one or more trapezoid shaped modules and folded over the modules.

Other embodiments include a flexible underlying sheet that further resists puncture from beneath, and which seals to the ground so as to resist penetration of water beneath the barrier. In some of these embodiments, the underlying sheet includes a cushioning layer. In still other of these embodiments, the underlying sheet is filled with dry sand, foam or some other compliant material that will not get wet from the flood water.

Embodiments include one or more anchoring support bases that resist rear-ward horizontal displacement of barrier modules. Each anchoring support base includes an underlying horizontal portion that extends in front of a vertical portion. The horizontal underlying portion is configured to be installed beneath the bottom of one or more barrier modules, such that the vertical portion rises behind and abuts the one or more barrier modules. The anchoring support base further includes an anchoring portion extending behind the vertical portion and configured for attachment to the ground by stakes or spikes driven through openings provided in the anchoring portion. The vertical and anchoring base portions are made from a rigid or semi-rigid material, such as a hard rubber or plastic, such that the vertical portion strongly resists any tendency of an abutting barrier module to be horizontally displaced, while the underlying portion prevents any possible rotation or tipping backward of the vertical portion due to horizontal pressure from the abutting barrier module.

In embodiments, each water-inflatable module can be placed within a rigid or semi-rigid frame that provides further support against the pressure of flood waters. Each frame includes a base upon which the water inflatable module is placed, and a rear wall that supports the back side of the water-inflatable module. The frame comprises a hollow interior surrounded by rigid or semi-rigid panels. At least one brace is provided that extends from the rear panel of the rear wall to the ground, for example at an angle of approximately 45 degrees, where it can be wedged in place or staked or otherwise fixed to the ground behind the frame. Holes are provided in the front panel of the rear wall so as to allow flood waters to enter the hollow interior of the frame and further anchor the frame and water-inflatable modules against the pressure of flood water. The base can include a raised perimeter that surrounds the water-inflatable module and helps to ensure that the water-inflatable module is not washed away or otherwise dislodged from the base.

The frame can be provided as a single construction, or it can be provided as separate base and rear wall elements that can be combined during installation. For example, a trough can be provided near the rear of the base into which the bottom of the rear wall is inserted. Or a trough can be provided in the front of the rear wall near its bottom edge into which a rear portion of the base can be inserted. A water fitting can be provided that functions to provide a sealed passage between the hollow interior of the rear wall and the hollow interior of the base, so that water entering the holes in the rear wall can flow into the base.

A first general aspect of the present invention is a water-inflatable barrier system that includes a first barrier module having first module flexible walls forming a first module shell configured to contain water within a first module interior of the first barrier module, said first module shell having a first module front, a first module rear, a substantially rectangular first module bottom, a first module length parallel to the first module front, a first module width perpendicular to the first module front, and a first module cross section that is wider at a first module bottom of the first barrier module than at a first module top of the first barrier module, a plurality of substantially horizontal and substantially vertical first module partition walls dividing said first module interior into a plurality of adjacent, water-tight first module cells shaped as rectangular parallelepipeds, front and rear first module partition walls of each first module cell being substantially parallel to the first module front of the first module shell, said first module cells being arranged in a plurality of vertically stacked layers that are offset from each other such that none of the first module front and rear partition walls aligns with a first module front or rear partition wall in a vertically adjacent layer, a first module water inlet in liquid communication with the first module interior, and a plurality of first module passages between the first module cells, said first module passages being configured to allow filling of all of the first module cells with water from the first module water inlet.

The water inflatable barrier system further comprises a first barrier module support frame, including a base portion configured for location on underlying terrain and for placement thereupon of the first barrier module, and a rear wall configured to extend upward behind the first barrier module in abutting relationship therewith when the first barrier module is placed onto the base portion, said base portion and rear wall having hollow interiors bounded by rigid or semi-rigid panels, at least one hole being provided in a front panel of said rear wall and configured to enable flood water, upon reaching the hole, to flow into the hollow interiors of the rear wall and base portion.

Embodiments further comprise at least one brace configured to extend from behind a rear panel of the rear wall to said underlying terrain.

In any of the above embodiments, the base can include a raised perimeter configured, in combination with the rear wall, to surround the first barrier module.

In any of the above embodiments, the base and rear wall can be unitary and can form a single construct. Or the base and rear wall can be separate constructs that can be assembled to form the first barrier module support frame. In some of these embodiments a trough is provided in one of the base and rear wall into which a portion of the other of the base and rear wall can be inserted during assembly of the first barrier module support frame. Any of these embodiments can further include a fitting configured to extend between the base and rear wall when they are assembled, and to provide liquid communication between the base and rear wall.

In any of the above embodiments, the barrier system can further include a second barrier module and a second barrier module support frame, sides of said first and second barrier module support frames being configured for mutual coupling together of the first and second barrier module support frames.

In any of the above embodiments, at least one of the braces can include an anchor configured to fix a distal end of the brace to the underlying terrain. In some of these embodiments the anchor includes a spike configured for insertion into the underlying terrain.

A second general aspect of the present invention is a method of constructing a barrier assembly. The method includes providing a water inflatable barrier system according to the first general aspect, placing the first barrier module support frame at a desired location, placing the first barrier module onto the base of the first barrier module support frame, and inflating the first barrier module with water.

Embodiments further include fixing a proximal end of a brace to a rear panel of the rear wall of the first barrier module support frame, and fixing a distal end of the brace to the underlying terrain. In some of these embodiments, fixing the distal end of the brace to the underlying terrain includes inserting a stake into the underlying terrain.

Any of the above embodiments can further include filling the hollow interior of the first barrier module support frame with water.

In any of the above embodiments, the base and rear wall of the first barrier module support frame can be separate constructs, and the method can further include assembling the base and rear wall together to form the first barrier module support frame.

And any of the above embodiments can further include inflating the first barrier module with air before placement thereof onto the base, and inflating the first barrier module with water can includes removal of said air from said first barrier module.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

The present invention is a portable, modular, water-inflatable barrier that has a structure similar to a sandbag dike or wall 100 and functions in a similar manner, but does not require delivery of large quantities of heavy materials to the construction site, does not require large amounts of labor to assemble, and is simple and inexpensive to remove when no longer needed. The barrier comprises one or more barrier modules 300, each of which is made of a light, flexible material, such as a heavy plastic for nanofiber, and can be transported to the construction site in a deflated state, after which it is positioned and filled with locally available water. In embodiments, the modules 300 are coated with a material such as Tyvek or liquid rubber that will tend to seal any puncture of the material that may occur. In some embodiments, each module 300 weights less than 250 pounds, so that it can be lifted and carried without using heavy machinery.

Figure 1:
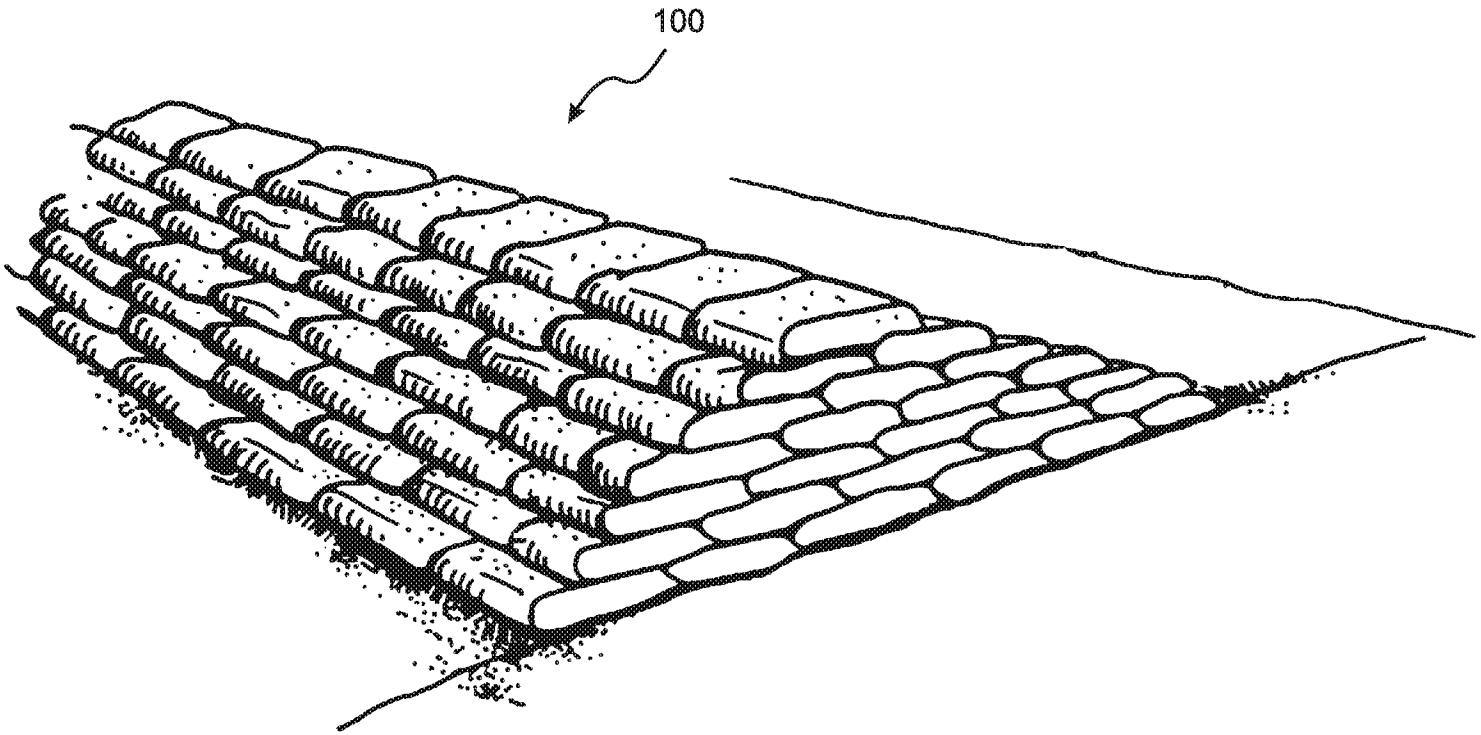
Figure 1 Prior Art
FIG. 1 is perspective view of a sandbag barrier of the prior art having a flat base.
Figure 2:
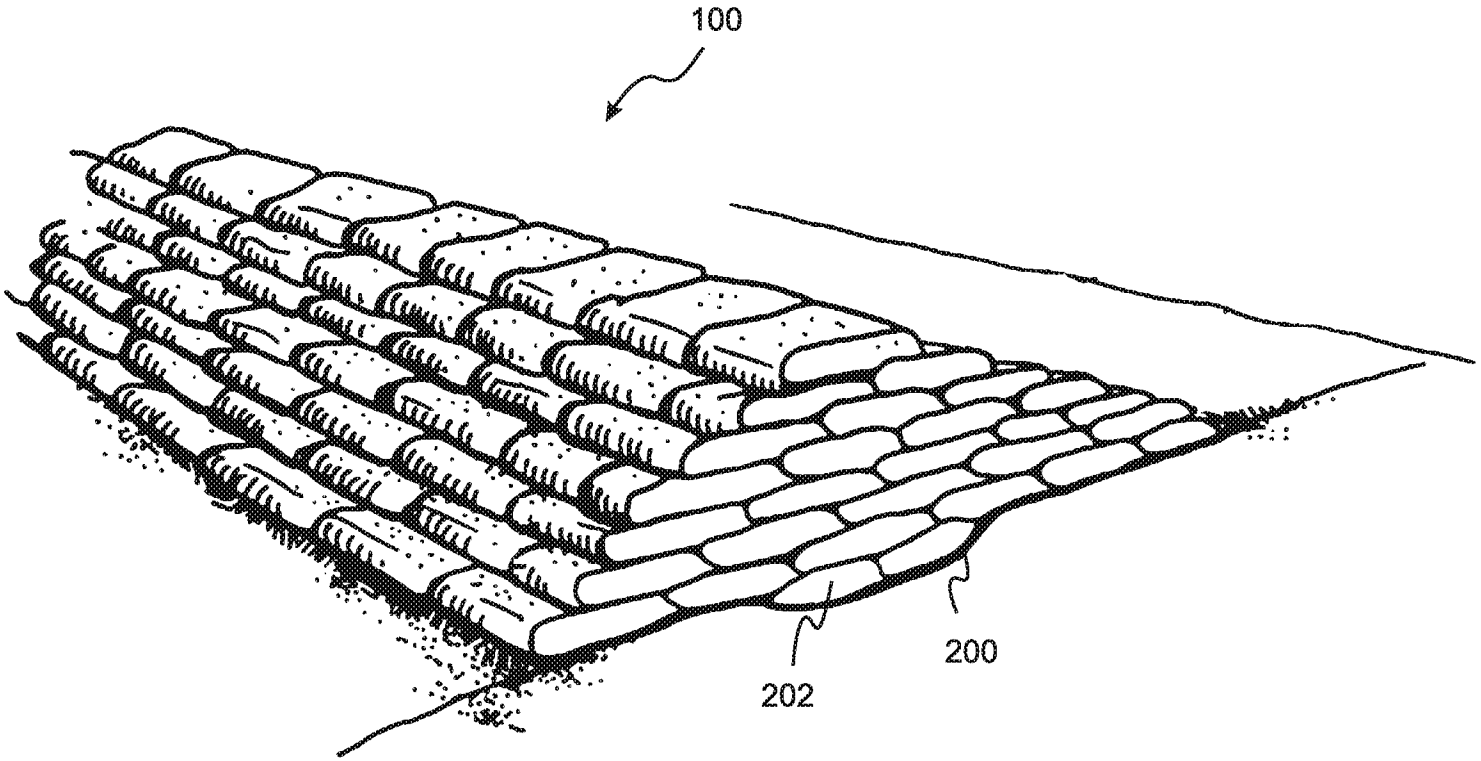
Figure 2 Prior Art
FIG. 2 is perspective view of a sandbag barrier of the prior art having two rows of sandbags at its base that are placed in a trench prepared at the construction site.
Figure 3:
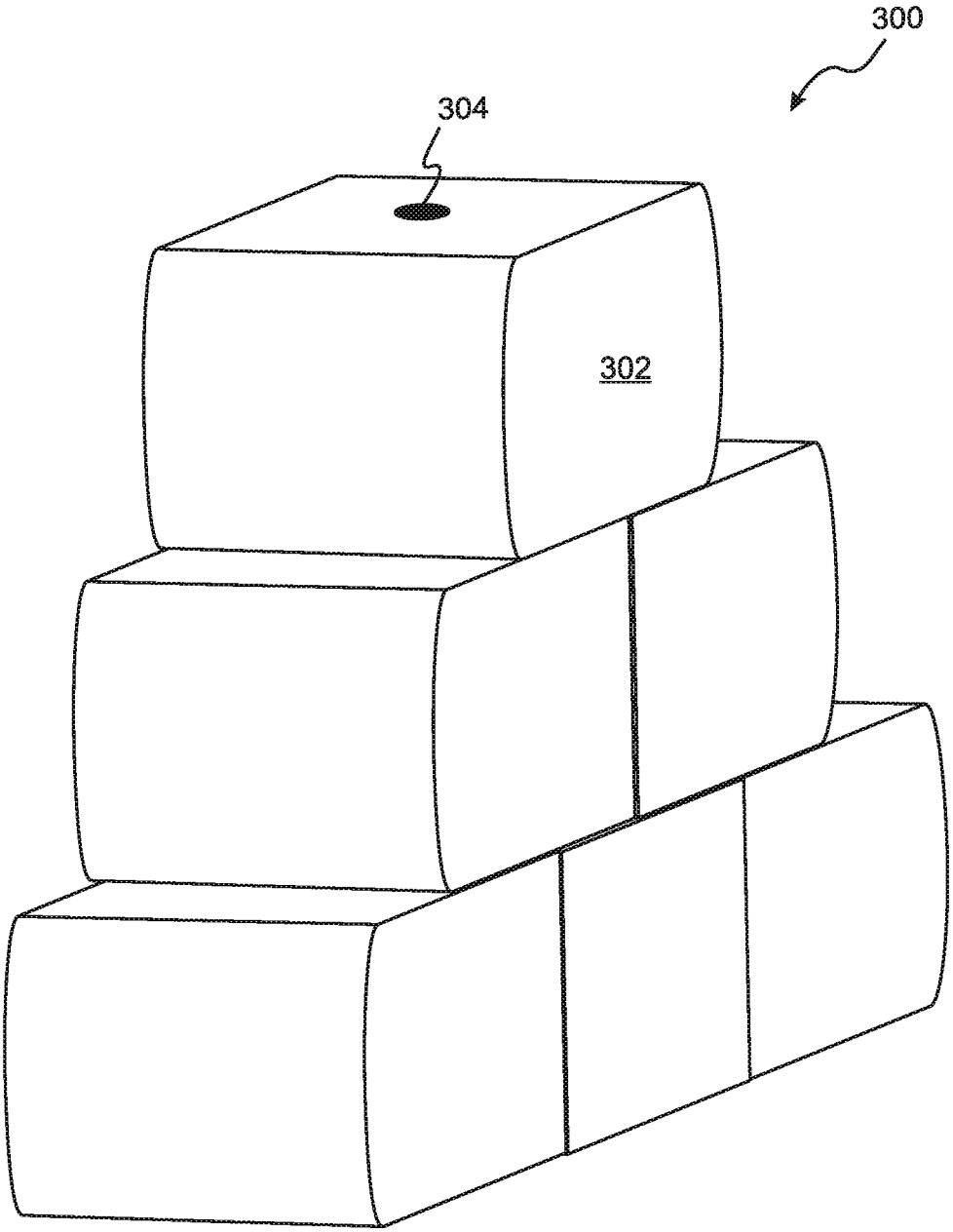
FIG. 3 is a perspective view of a single module that is one cell in length in an embodiment of the present invention.
Figure 4A:
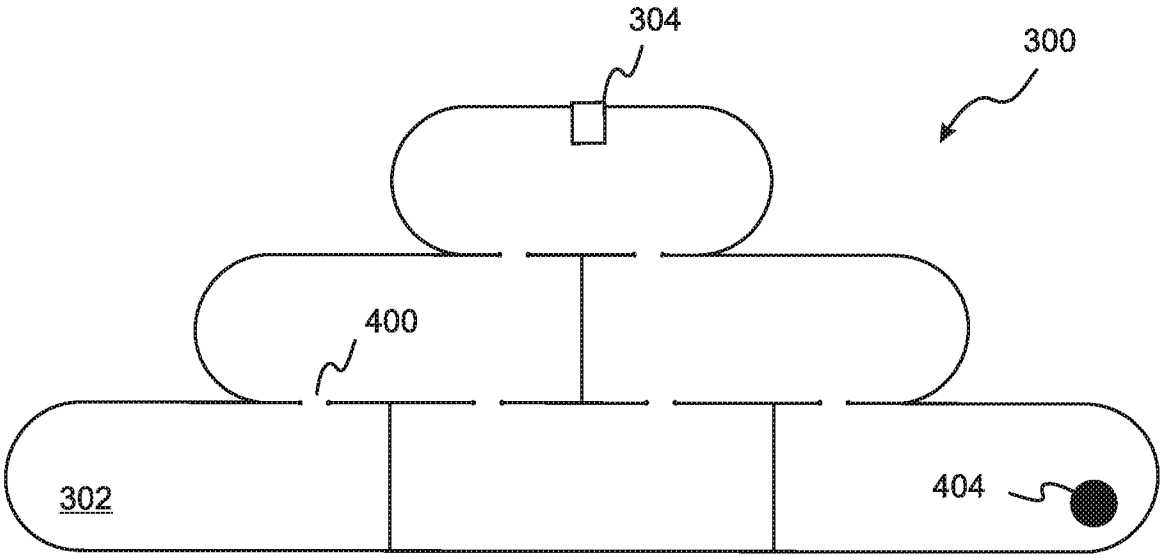
FIG. 4A is a cross sectional view of a module in an embodiment having a water inlet on top, a water outlet near the bottom, and simple passages between tops and bottoms of cells.

In the embodiment of FIG. 3, the interior of the module is divided into a plurality of approximately rectangular cells 302. A port 304 for filing and/or emptying the module 300 is provided in the top surface. With reference to FIG. 4A, passages 400 between the tops and bottoms of the cells 302 allow the entire barrier module 300 to be filled from a single water inlet 304. In the illustrated embodiment, a separate water outlet 404 is provided at the base of the structure 300.

Figure 4B:
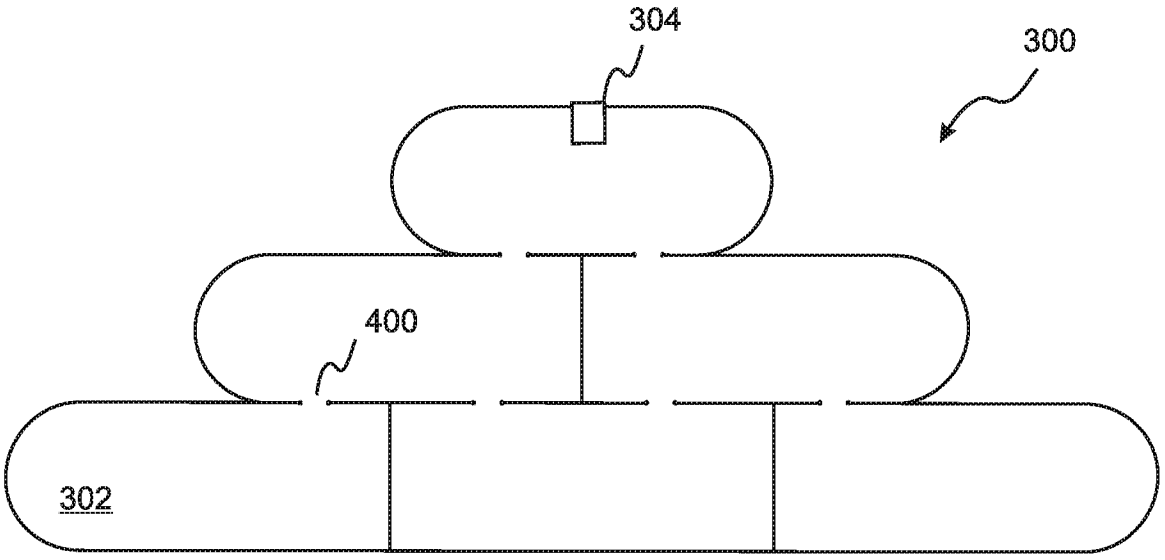
FIG. 4B is a cross sectional view of a module in an embodiment similar to FIG. 4A, but including only a water port at the top through which the barrier is both filled and emptied with water.

With reference to FIG. 4B, in some embodiments a separate water outlet 404 is not included, and instead water is both added and removed through a common port 304 at or near the top or bottom of the barrier module 300. This allows water to be removed from the barrier module 300 without introducing air, so that removing the water causes the barrier module to be collapsed in preparation for packing and transport.

In some embodiments, lateral passages (not shown) are provided at least between adjoining cells in the bottom rear row, so that a single outlet can drain all of the cells 302 in the barrier module 300.

Figure 5:
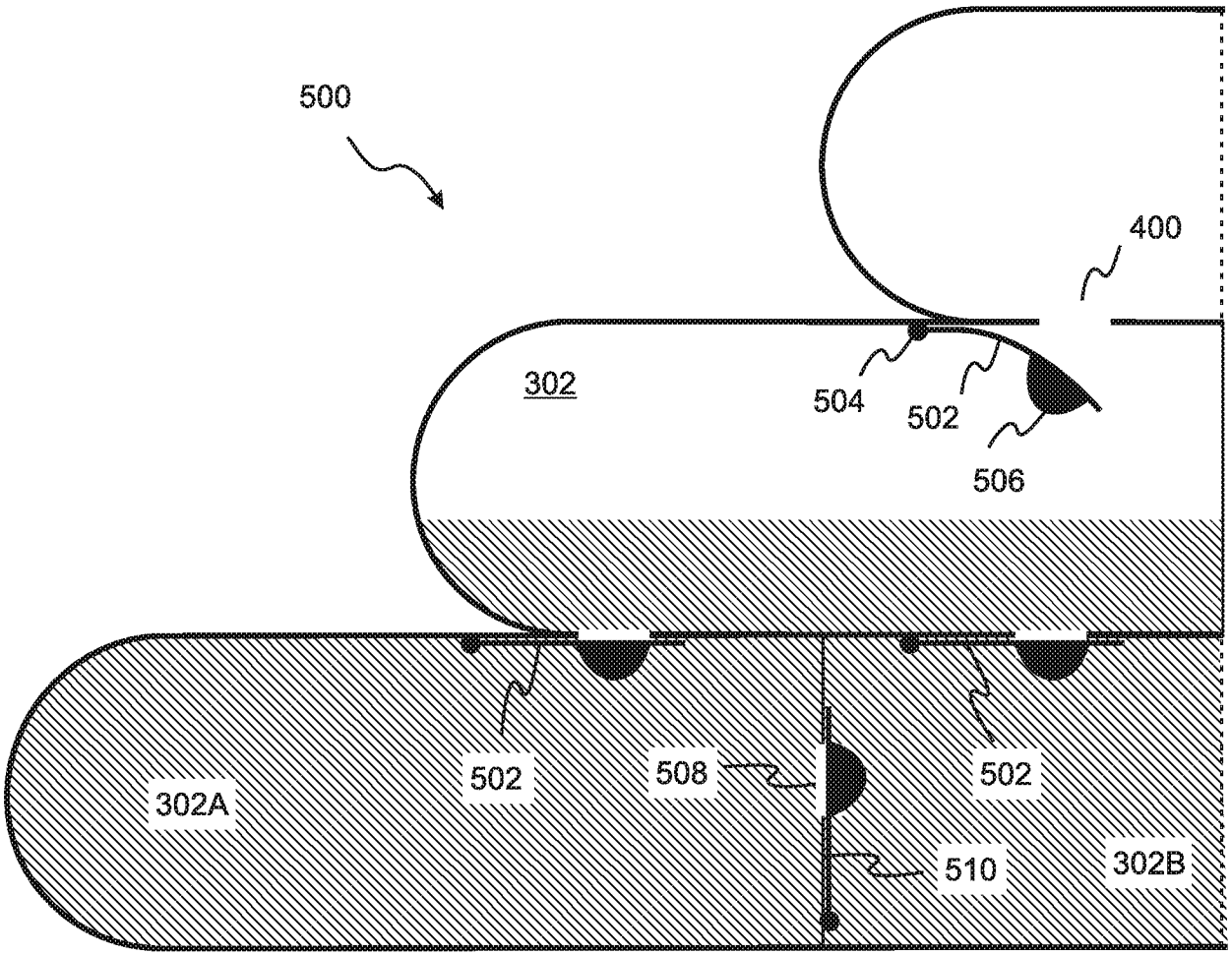
FIG. 5 is a partial cross-sectional view of a module in an embodiment having passages between tops and bottoms of cells that are closable by passive valves.

With reference to FIG. 5, in some embodiments 500 the cells 302 include passive automatic valves 500 that seal the passages 400 after the cells 302 are filled with water, so that deflation of one cell due to a puncture or some other cause will not cause the cells beneath it to deflate. In the embodiment 500 of FIG. 5, the valves 502 are flaps of elastic material joined to the upper surfaces of the cells 302 by living hinges 504. A small air bladder 506 is included in the region of the valve 502 that is positioned to cover the passage 400. When the cell 302 is empty, gravity causes the valve 502 to fall away from the passage 400, so that the cell 302 can fill with water. However, once the cell 302 is full of water, the air bladder 506 lifts the valve 502 into place and closes the passage 400. Once the valves 502 are closed, if a cell should develop a leak and deflate, only the cells directly above it will be affected.

In addition, the embodiment 500 of FIG. 5 includes lateral passages 508 between neighboring cells at the lowest level of the barrier, so that the entire barrier can be emptied through a single water outlet 404 located at the lower rear of the structure 500. These lateral passages 508 include automatic valves 510 that will allow water to flow toward the rear as the cells empty from back to front, but will prevent water flowing from rear to front if one of the front cells is damaged.

Typically, the cells in the front row 302, 302A will be the cells that are directly exposed to threats such as debris carried by flood waters. The front cells 302, 302A are therefore the ones most likely to be damaged or punctured. In the embodiment of FIG. 5, if a cell 302A in the bottom front row is punctured, the lateral valve 510 will prevent water from flowing out of the cell next to it 302B and into the damaged cell 302A. However, if the rear cells 302B are drained first during the normal drainage process, then the lateral valves 510 will open and water from the front cells 302A will flow out.

Figure 6:
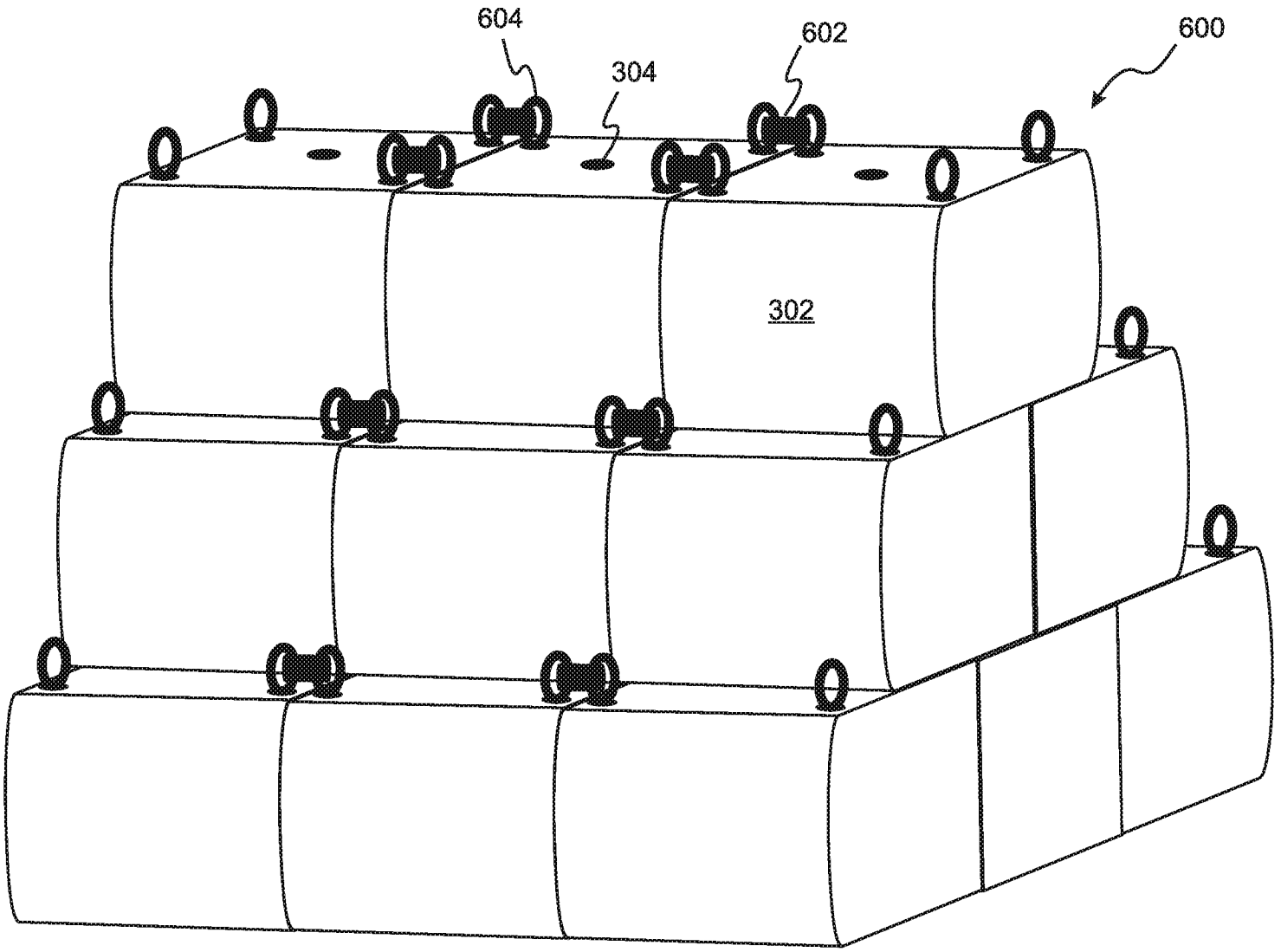
FIG. 6 is a perspective view showing three of the modules of FIG. 3 interconnected using loops and straps to form a partial barrier.

Embodiments of the present invention comprise a plurality of modules 300 that are arranged side-by-side and coupled to each other. FIG. 6 illustrates the interconnection of three of the modules 300 illustrated in FIG. 3 so as to form at least part of a barrier 600. In this embodiment, the coupling mechanism that interconnects the modules 300 comprises loops 604 that are attached to the upper surfaces of the cells, whereby adjacent loops of adjoining modules are attached by straps 602. In similar embodiments, the loops 604 are interconnected by clamps or other fastening means known in the art.

Figure 7:
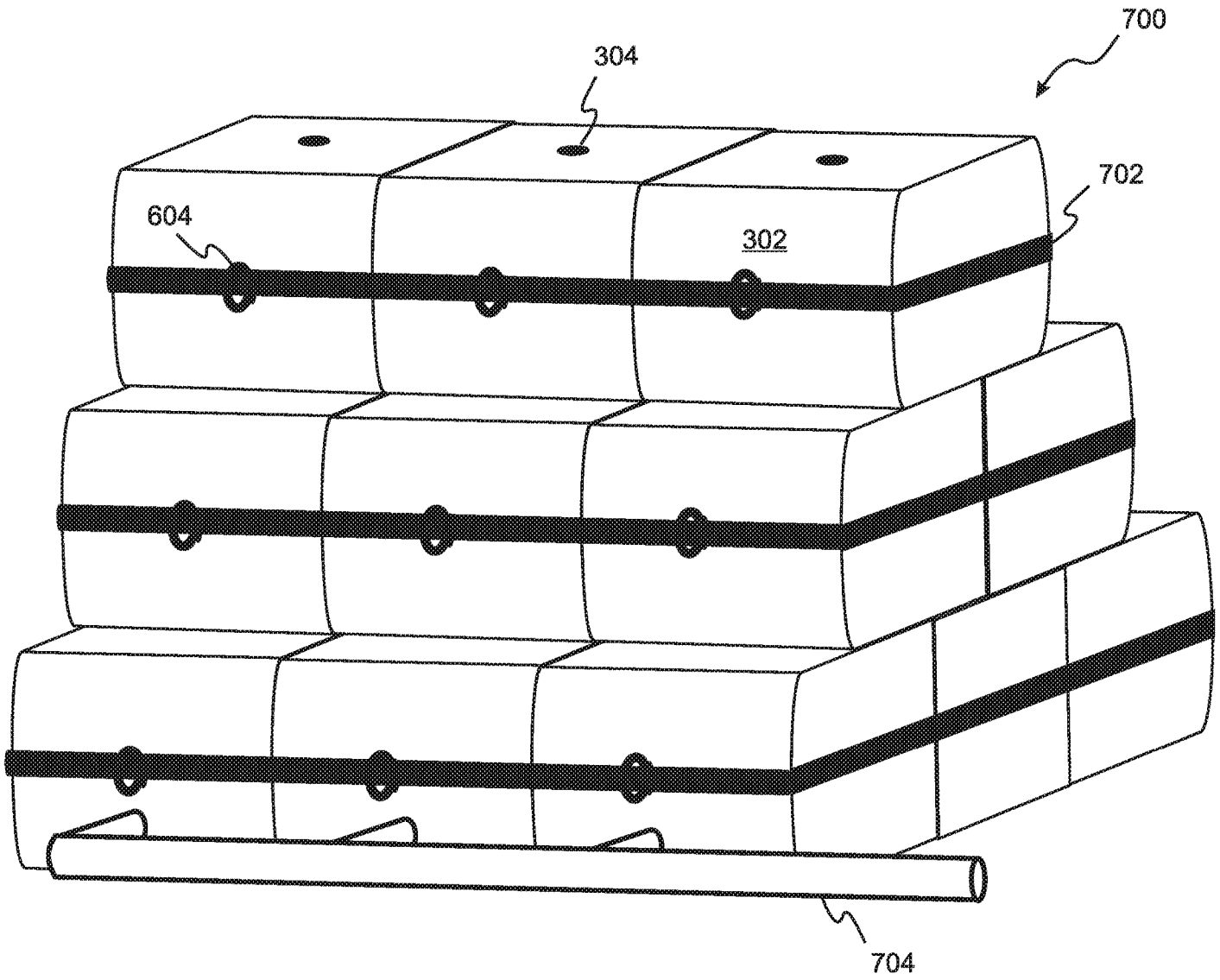
FIG. 7 is a perspective view of an embodiment similar to FIG. 6, but wherein a single strap extends through loops positioned on front faces of more than two of the modules.

FIG. 7 is a perspective rear view of an embodiment 700 similar to FIG. 6, except that the loops 604 are located on both the front-facing and rear-facing surfaces of the modules 300, and a single, continuous strap 702 is passed through the loops 604 and around the modules 300 so as to attach the modules 300 and form the barrier 700. The embodiment of FIG. 7 also includes a manifold 704 that can be used to fill all of the modules 300 simultaneously through fill-ports provided in the bases of the modules 300.

Figure 8:
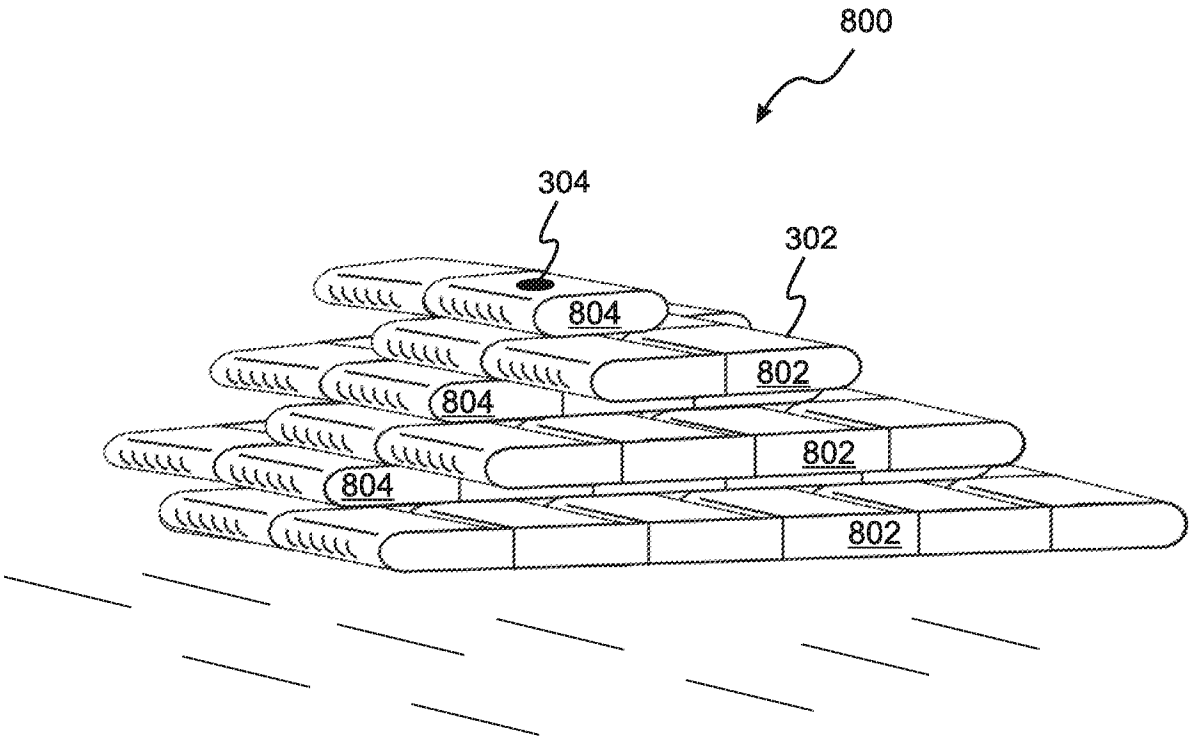
FIG. 8 is a perspective view of a module in an embodiment where the module has interlocking ends.

With reference to FIG. 8, in some embodiments the barrier modules 800 have interlocking ends that provide structural cooperation and a water-tight seal between adjacent modules. FIG. 8 is a perspective view of a single module 800 that is three cells wide. The module includes alternate rows of cells 802 that extend from the ends by a length of one cell, while the interleaved rows 804 do not.

The opposite pattern is provided on the other end of the module 800. It can be seen that a second module of the same configuration can be positioned so that its extended cells fit between the extended cells 802 of the adjacent module 800. In some of these embodiments, as mentioned above, the modules 800 can be initially filled with air and positioned with the ends interlocking, after which the modules 800 are filled with water while the displaced air is allowed to escape through pressure valves 304 provided at the tops of the modules 800.

Figure 9:
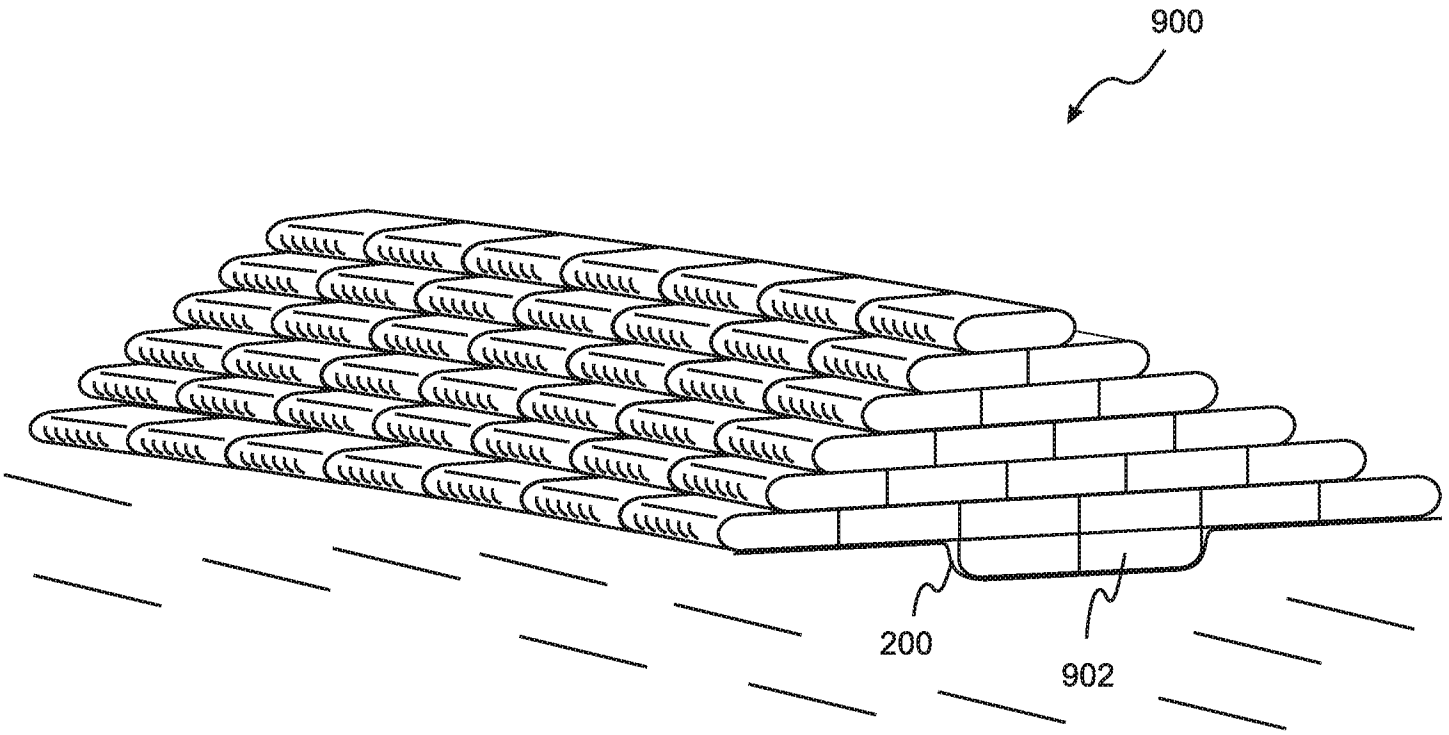
FIG. 9 is a perspective view of an embodiment wherein the barrier has two additional rows of cells at its base that are placed in a trench prepared at the construction site.

With reference to FIG. 9, in further embodiments, additional rows 902 of cells extend below the base of the inflatable barrier 900 so that they can be placed in a trench 200 prepared at the construction site, thereby further resisting dislodgement of the barrier 900 by flood waters or other forces.

Figure 10:
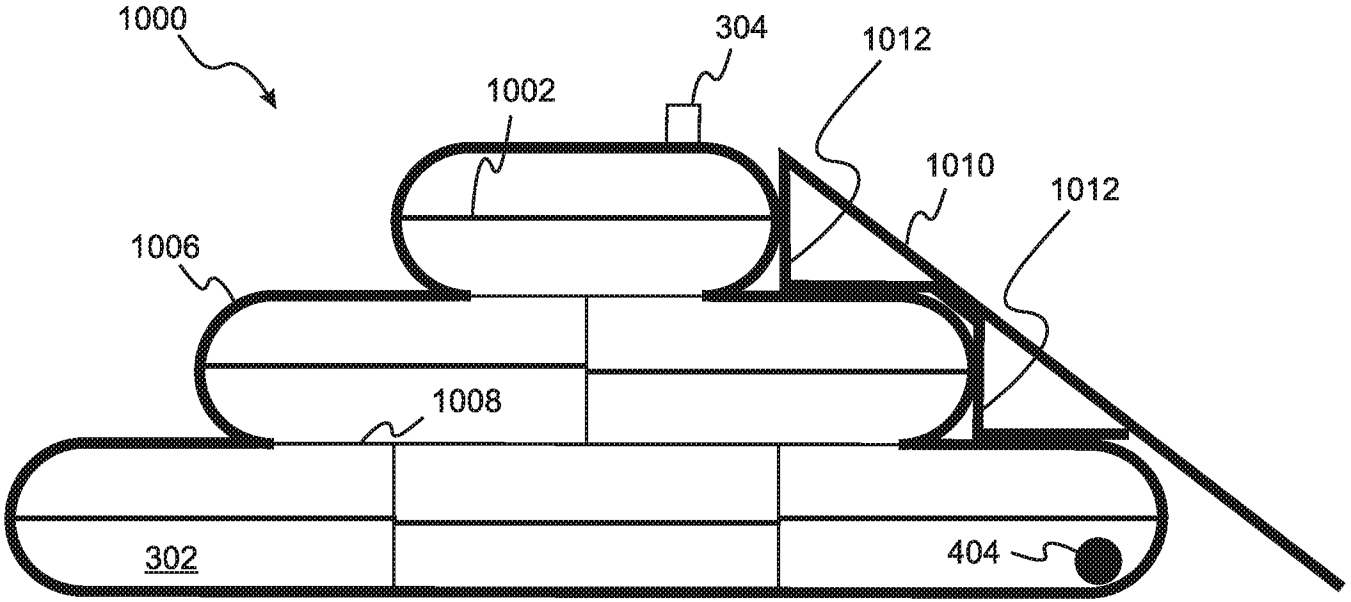
FIG. 10 is a cross sectional view of an embodiment that includes stiffening rods within the cells and a series of bent metal rods located at intervals along the rear side of the barrier.

With reference to FIG. 10, in some embodiments the outer shell is made of a much thicker material than the internal cell walls 1008, so as to better resist puncture by exterior threats. In similar embodiments, the outer shell 1006 is a double layer of material, so that penetration of the outer layer does not affect the adjacent cell, so long as the inner layer remains intact. In some embodiments, only the portion of the outer shell 1006 that will face the flood or other threat is thicker, double-walled, or otherwise reinforced.

In embodiments, the internal cell walls enable the barrier 300 to maintain its shape when it is subjected to externally applied, lateral forces, such as pressure from flood waters. As illustrated in FIG. 10, in some embodiments, the shape of the barrier 1000 is made even more rigid by including within the cells 302 stiff, lightweight rods 1002 or panels made of plastic, bamboo, or a similar material.

In certain embodiments, the shape of the barrier is supported by external reinforcing structures. The embodiment of FIG. 10 includes a plurality of bent metal rods 1010 that can be located at intervals along the rear side of the barrier 1000. The rods 1010 include vertical sections 1012 that can be placed against the back sides of cells at the rear of the barrier 1000 so as to provide further resistance to horizontal forces applied to the front of the barrier.

Figure 11:
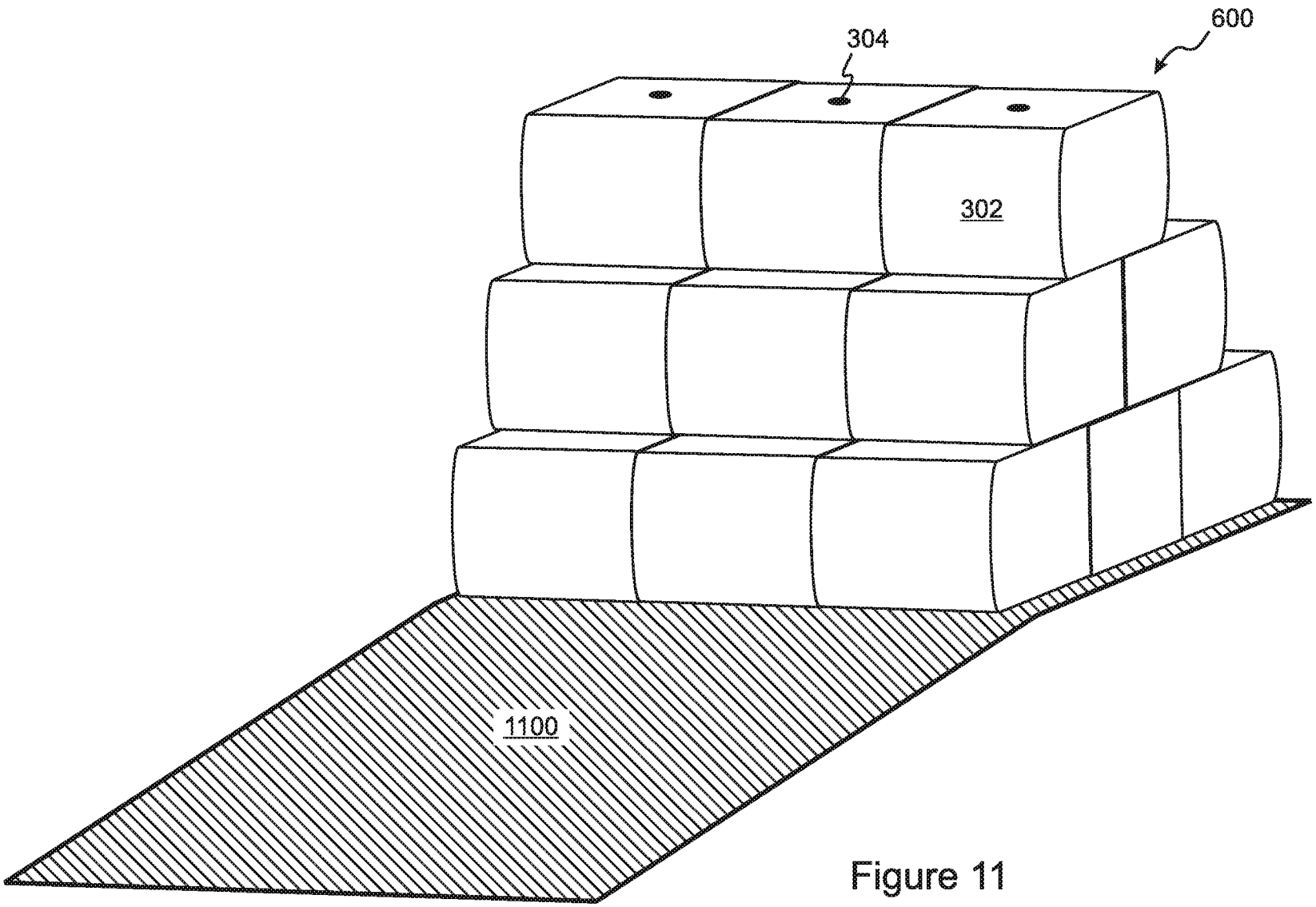
FIG. 11 is a perspective view of an embodiment that includes an anchoring sheet underlying the barrier and extending under the water to as to further resist lateral displacement of the barrier by the water.

The embodiment of FIG. 11 includes an anchoring sheet 1100 that is attached to the bottom of the barrier 600 and extends in front of the barrier 600, where it is pressed against the ground by the water in front of the barrier, so that there is a high friction between the anchoring sheet 1100 and the ground that further inhibits horizontal displacement of the barrier 600 by flood water.

In embodiments, the flexible material of the barrier 600 allows the base of the barrier 600 to form a seal with ground even if the ground is rough. In the embodiment of FIG. 11, the underlying sheet 1100 also increases resistance to puncture of the barrier 600 from beneath, and also forms a seal with the ground so as to further resist penetration of water beneath the barrier 600. In some of these embodiments, the underlying sheet 1100 includes a cushioning layer such as foam or a puncture-proof air bag that enables the underlying sheet to form a seal with very rough ground, and also further helps to avoid puncture of the barrier from beneath. In certain of these embodiments, the underlying sheet 1100 is filled with dry sand, foam or some other compliant material that will not get wet from the flood water.

Figure 12:
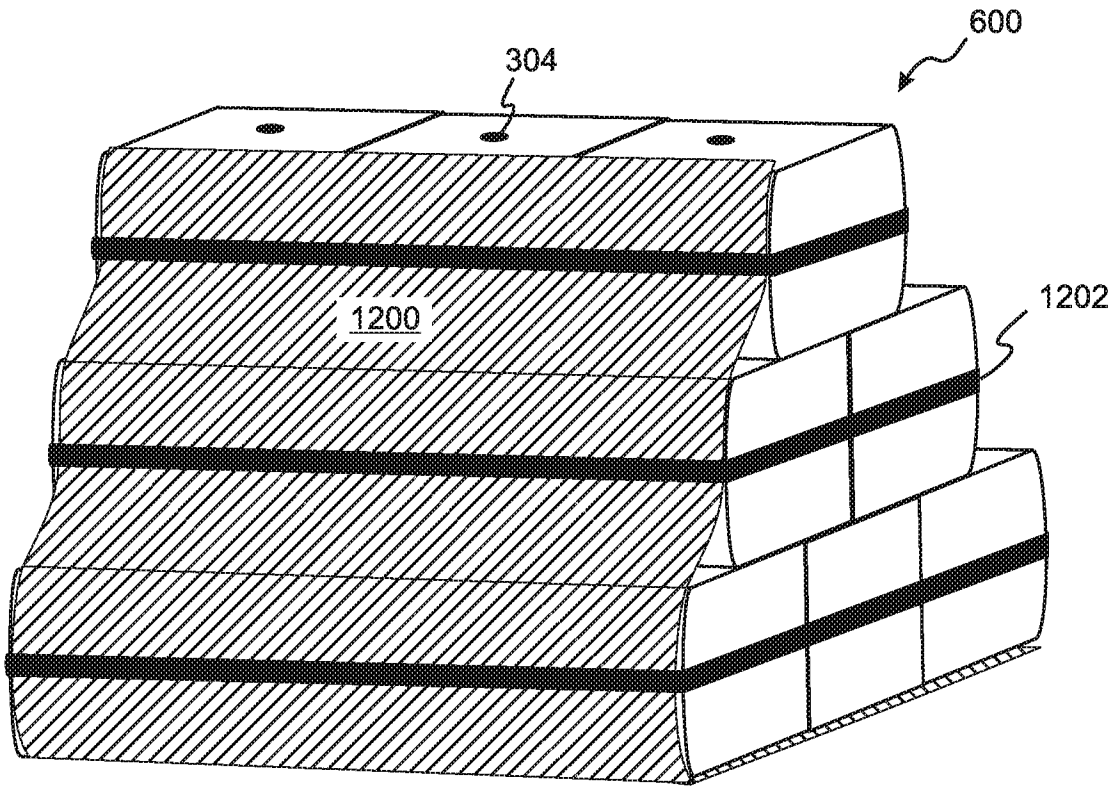
FIG. 12 is a perspective view of an embodiment that includes a covering sheet that extends under the barrier and over the front face of the barrier, so as to inhibit leakage of water under and between the cells.

FIG. 12 illustrates a similar approach, wherein a cover sheet 1200 is placed beneath the barrier 600, and is folded over the front of the barrier 600 to further protect the barrier 600 from punctures and other damage, and to help to prevent water from leaking between the modules 300. In the embodiment of FIG. 12, the sheet 1200 is attached to the front surface of the barrier 600 by surrounding straps 1202.

In embodiments, the cover sheet 1200 is sufficiently flexible to allow it to conform closely to the underlying shape of the water-facing surface of the barrier 600. And in some of these embodiments, the cover sheet 1200 is made from a material that naturally clings to the water-facing surface of the barrier 600 due to static electrical attraction.

Figure 13:
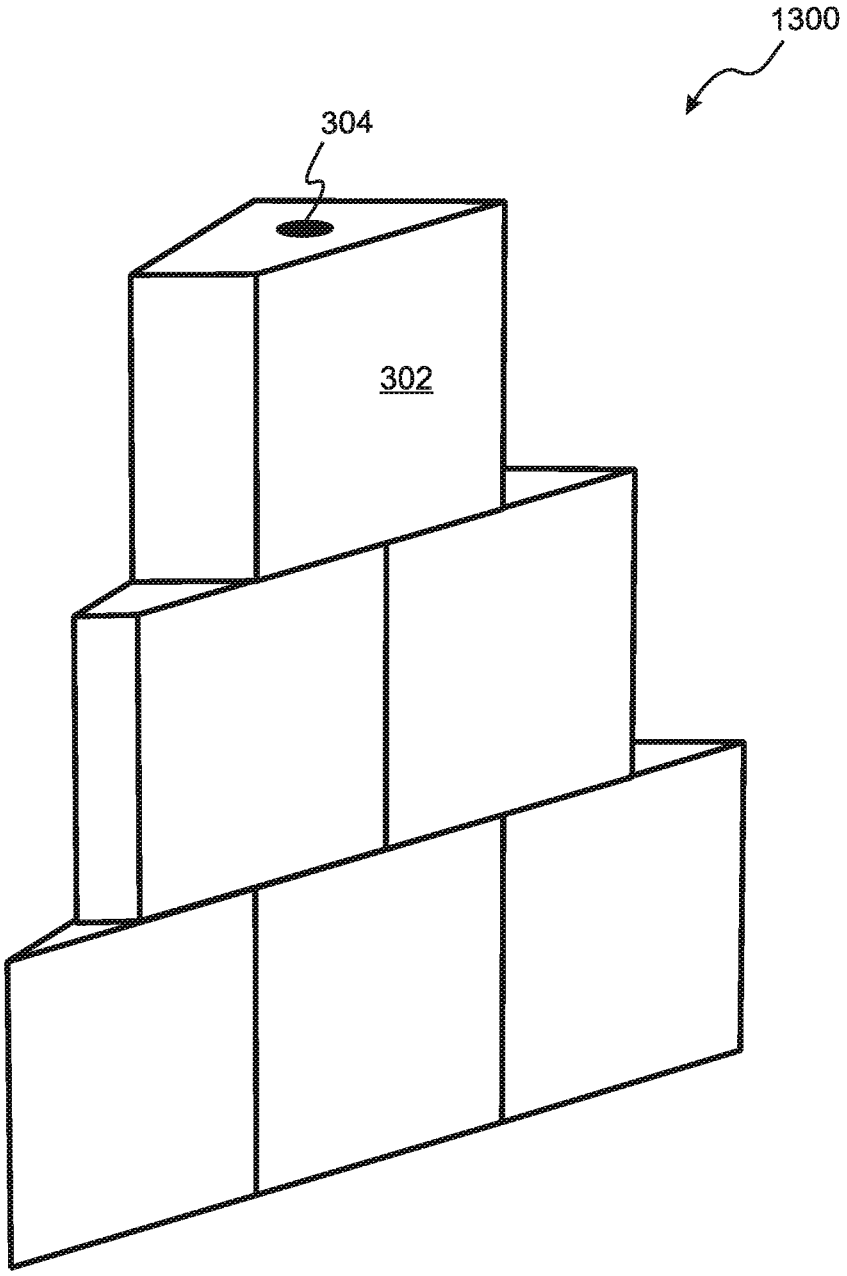
FIG. 13 is a perspective view of a wedge-shaped module having a triangular base.
Figure 14B:
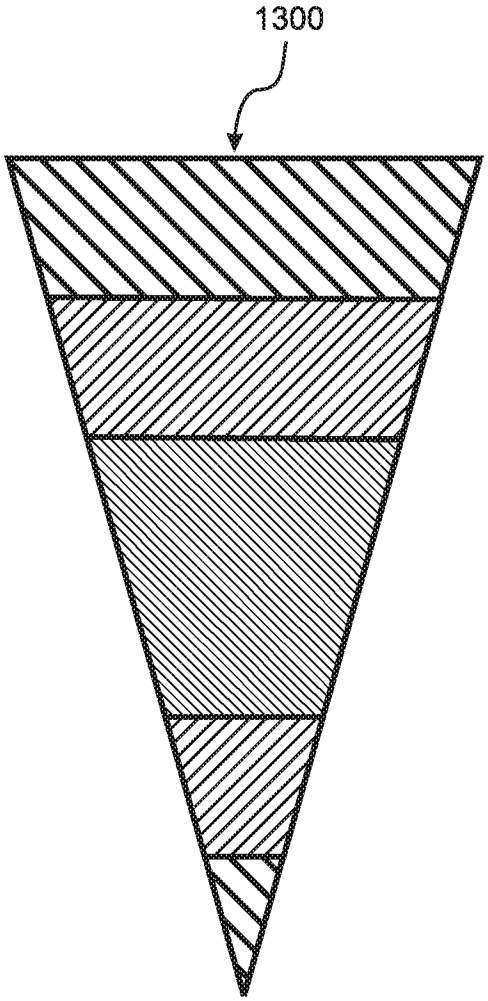
FIG. 14B is a top view of the module of FIG. 13.
Figure 14A:
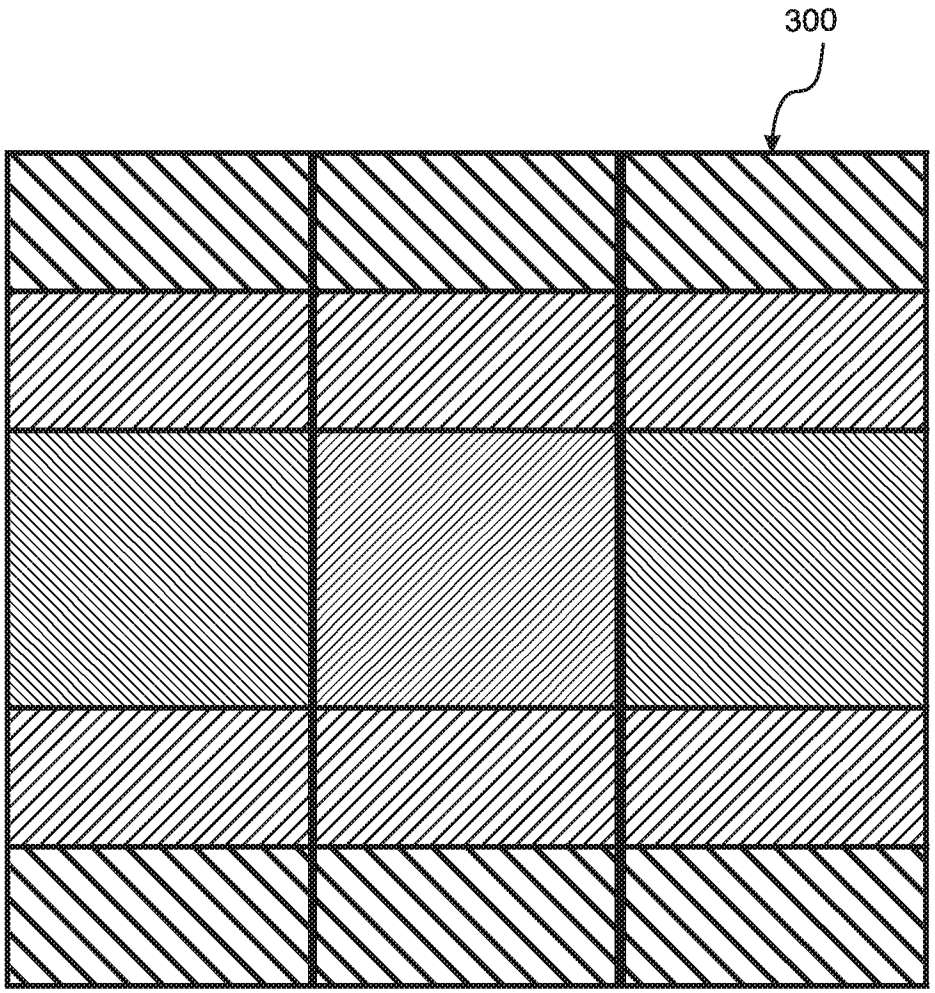
FIG. 14A is a top view of the group of three adjacent modules of FIG. 6A.

Barrier modules 300 as illustrated for example in FIG. 3 are suitable for constructing barriers having an approximately rectangular footprint, for example to form a barrier or dike that extends in a straight line between opposing anchor locations. With reference to FIG. 13, embodiments of the present invention include modules 1300 that are shaped as triangular or trapezoidal wedges that can be included in a barrier assembly so as to bend and curve the resulting barrier into a desired shape. FIG. 14A is a top view illustrating three modules 300 of the type shown in FIG. 3. Cross-hatching is used to indicate the regions of different height. FIG. 14B is a top view of a wedge-shaped module 1300 having a triangular footprint that can be combined with the modules 300 of FIG. 14A to form a barrier with bends and curves.

In embodiments, wedge modules 1300 are provided having a convenient wedge angle, so that multiple wedge modules 1300 can be combined to obtain desired bend angles. For example, wedge modules 1300 having a 15 degree wedge angle can be combined to provide a bend or curve of 15 degrees, 30 degrees, 45 degrees, 60 degrees, 75 degrees, and 90 degrees. Providing wedge modules 1300 with small wedge angles also reduces the weight and the number of cells included in a single wedge.

Figure 15A:
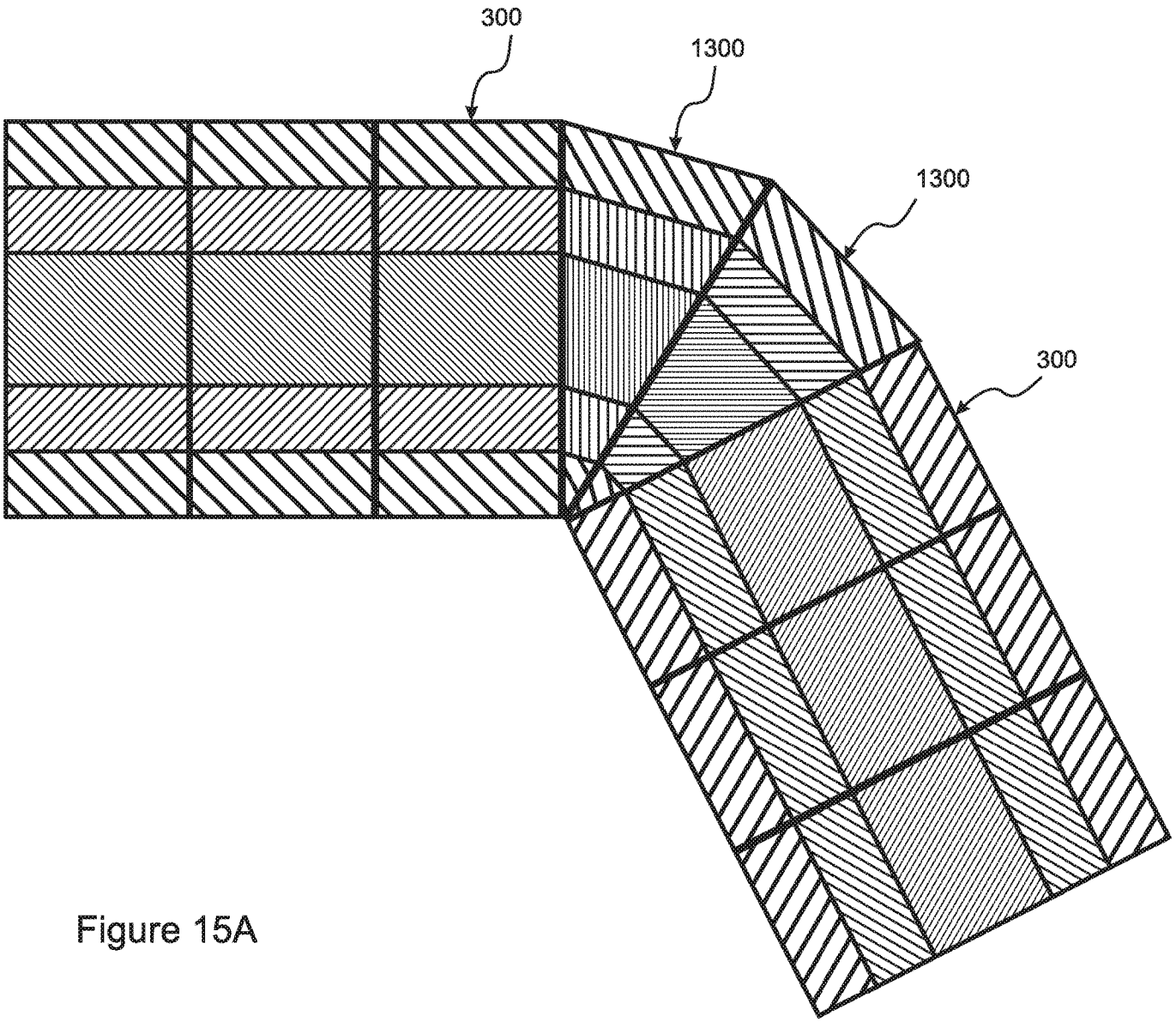
FIG. 15A is a top view of a barrier assembled from groups of modules as shown in FIGS. 14A and 14B.
Figure 15B:
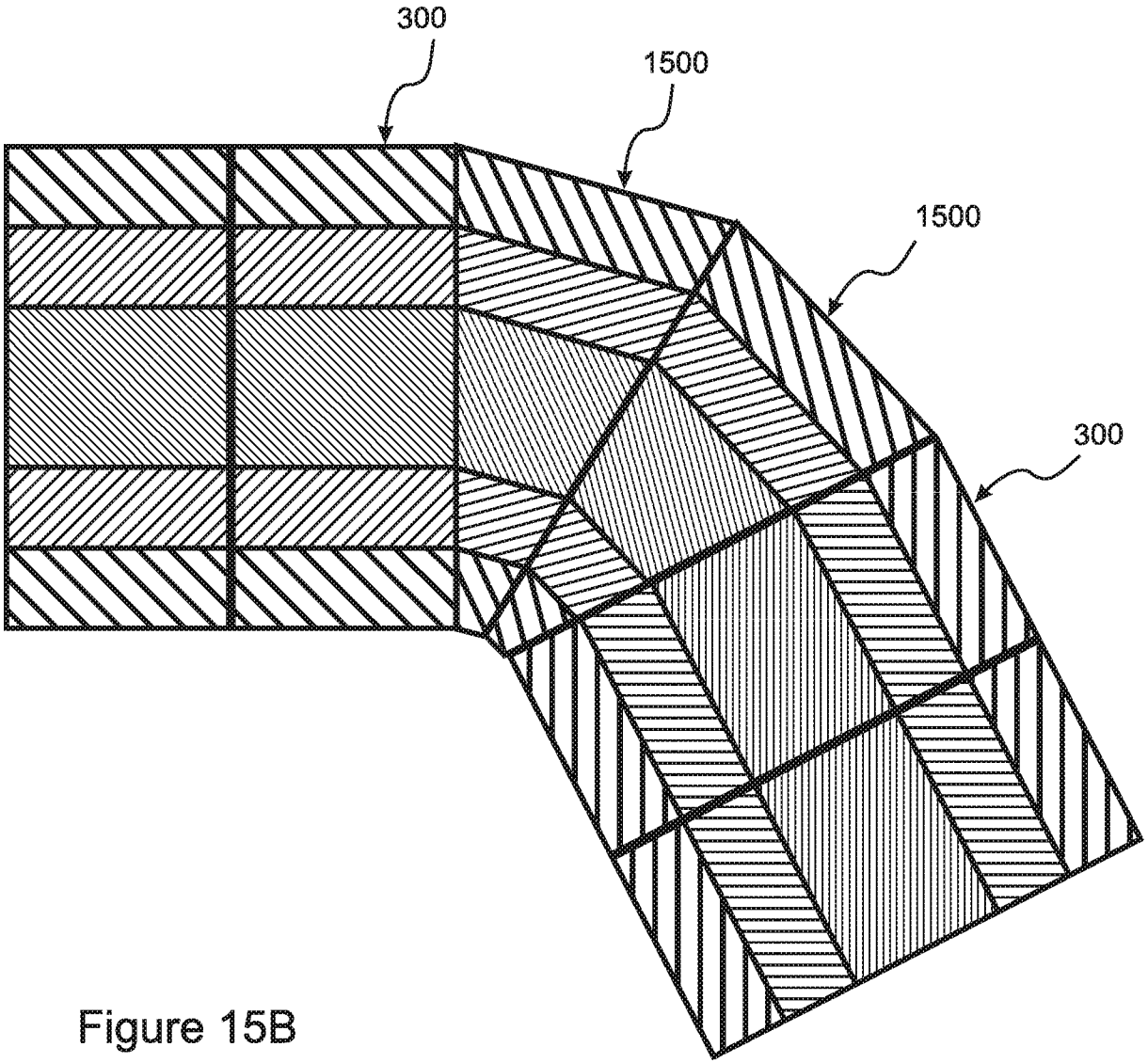
FIG. 15B is a top view of a barrier similar to FIG. 15A, but including wedge-shaped modules having a trapezoidal base.

FIG. 15A is a top view of a barrier that includes two 30° wedge modules 1300 between groups of rectangular modules 300 to create a barrier having a bend of approximately 60 degrees. FIG. 15B is a top view of a similar barrier, in which the wedge modules 1500 have trapezoidal footprints rather than triangular footprints, thereby providing a more gradual bend (greater radius of curvature).

Figure 16:
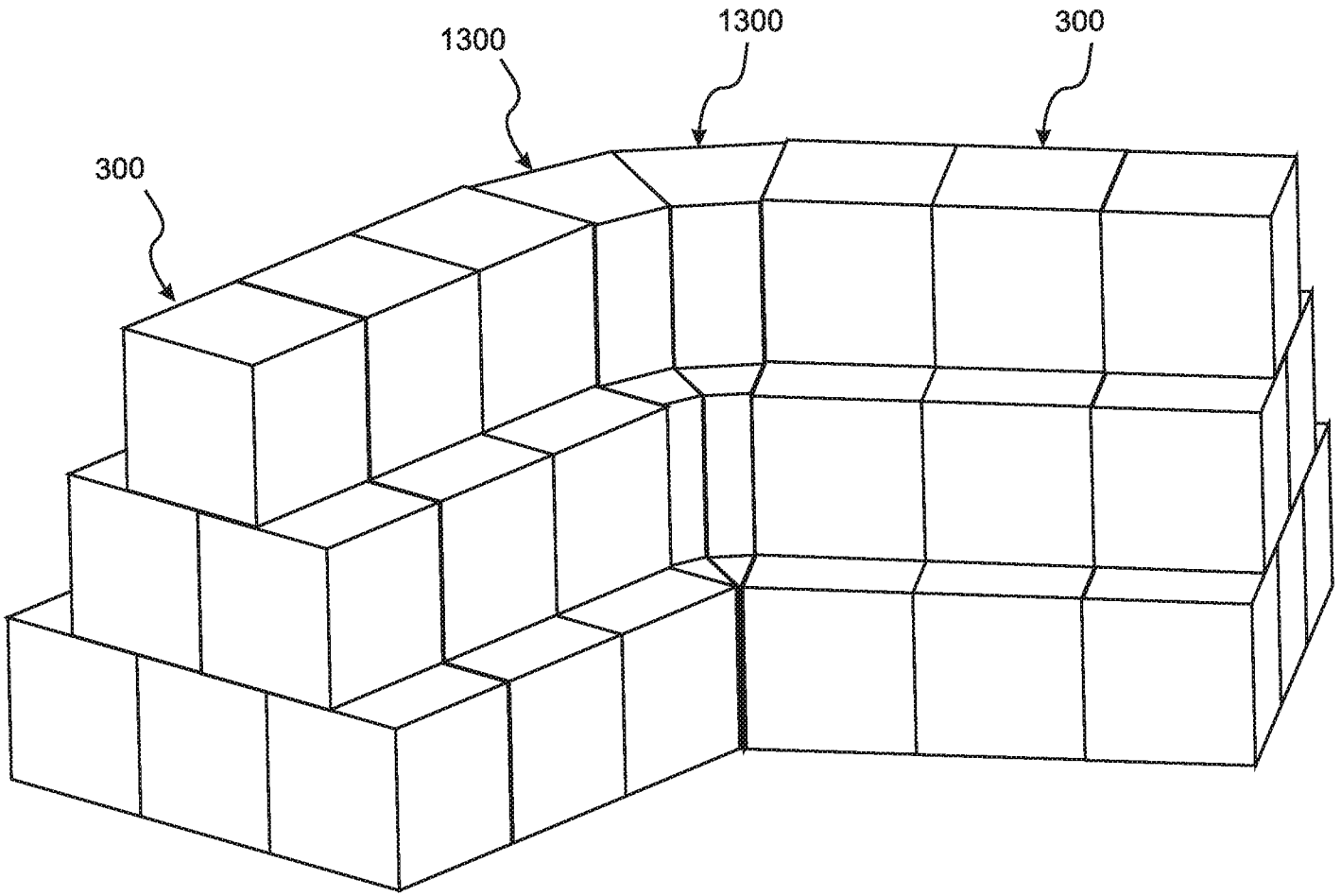
FIG. 16 is a perspective view of the barrier of FIG. 15A.
Figure 17:
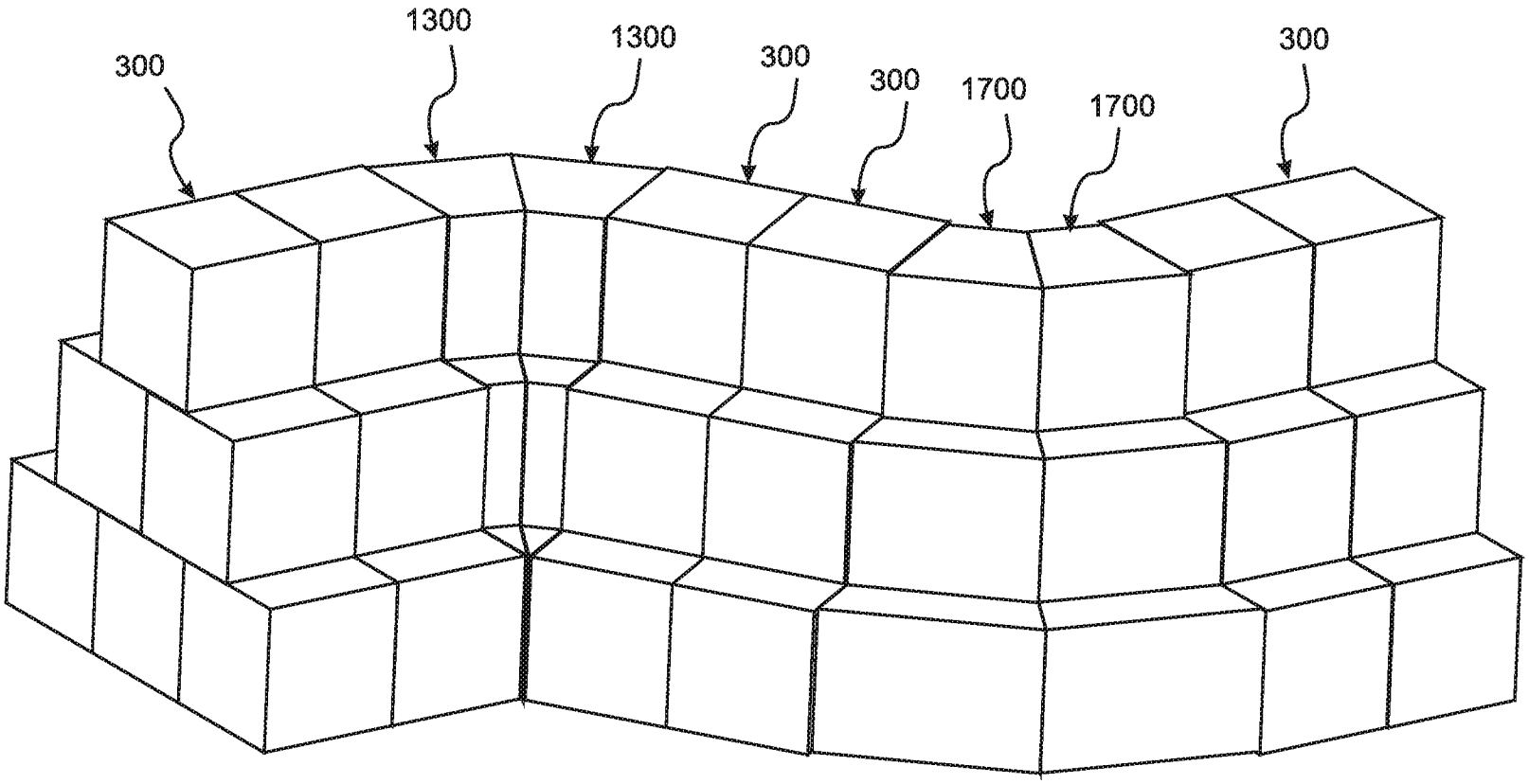
FIG. 17 is a perspective view of a barrier similar to FIG. 16, except that wedge-shaped modules are installed therein in both a front-to-front configuration and a front-to-rear configuration.

FIG. 16 is a perspective view of the barrier of FIG. 15A. In the embodiment of FIG. 17, a barrier similar to FIG. 16 includes a second pair of wedge modules 1700 included in a reversed orientation, thereby creating a barrier having two parallel ends that are offset from each other by a slanted middle section. In the embodiment of FIG. 17, the inverted wedge modules 1700 are structurally identical with the non-inverted wedge modules 1300, and are simply installed in a different orientation.

Figure 18:
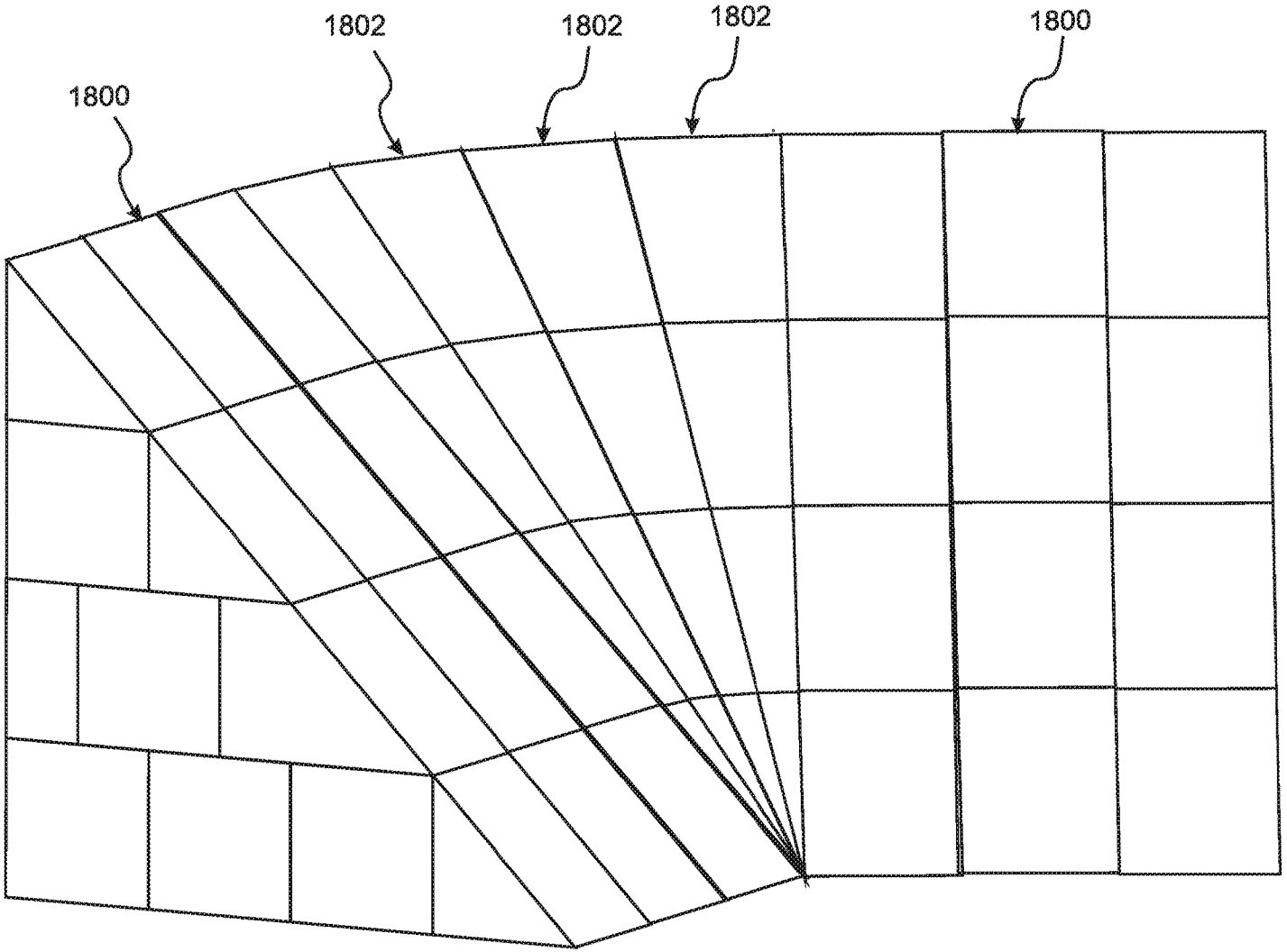
FIG. 18 is a perspective view of a barrier formed from modules having vertical rear surfaces.

It will be understood by those of skill in the art that the module shapes included in the present disclosure are not limited to only the shapes that are illustrated in the figures. In particular, the present invention includes embodiments wherein one side of each module 1800 is vertical, as shown for example in FIG. 18. In the embodiment of FIG. 18, rectangular modules 1800 and wedge modules 1802 are combined to form a barrier with a bend, where one side of the barrier is vertical and the other side is sloped.

According to the requirements of a given implementation, the sloped side of the barrier can be oriented either toward or away from the water that is being contained. Directing the sloped side toward the water can be advantageous because the weight of the water on top of the sloped surface can help to stabilize the barrier by pressing it against the underlying ground. On the other hand, directing the vertical side of the barrier toward the water can be advantageous if it is desirable to maintain a uniform depth of the contained water, or if the barrier is being used to temporarily raise the vertical sides of an existing waterway that is in danger of overflowing.

It will be understood by those of skill in the art that in embodiments the cells of the wedge module can be staggered laterally so as to interlock with the sides of rectangular modules such as those shown in FIG. 8.

Figure 19:
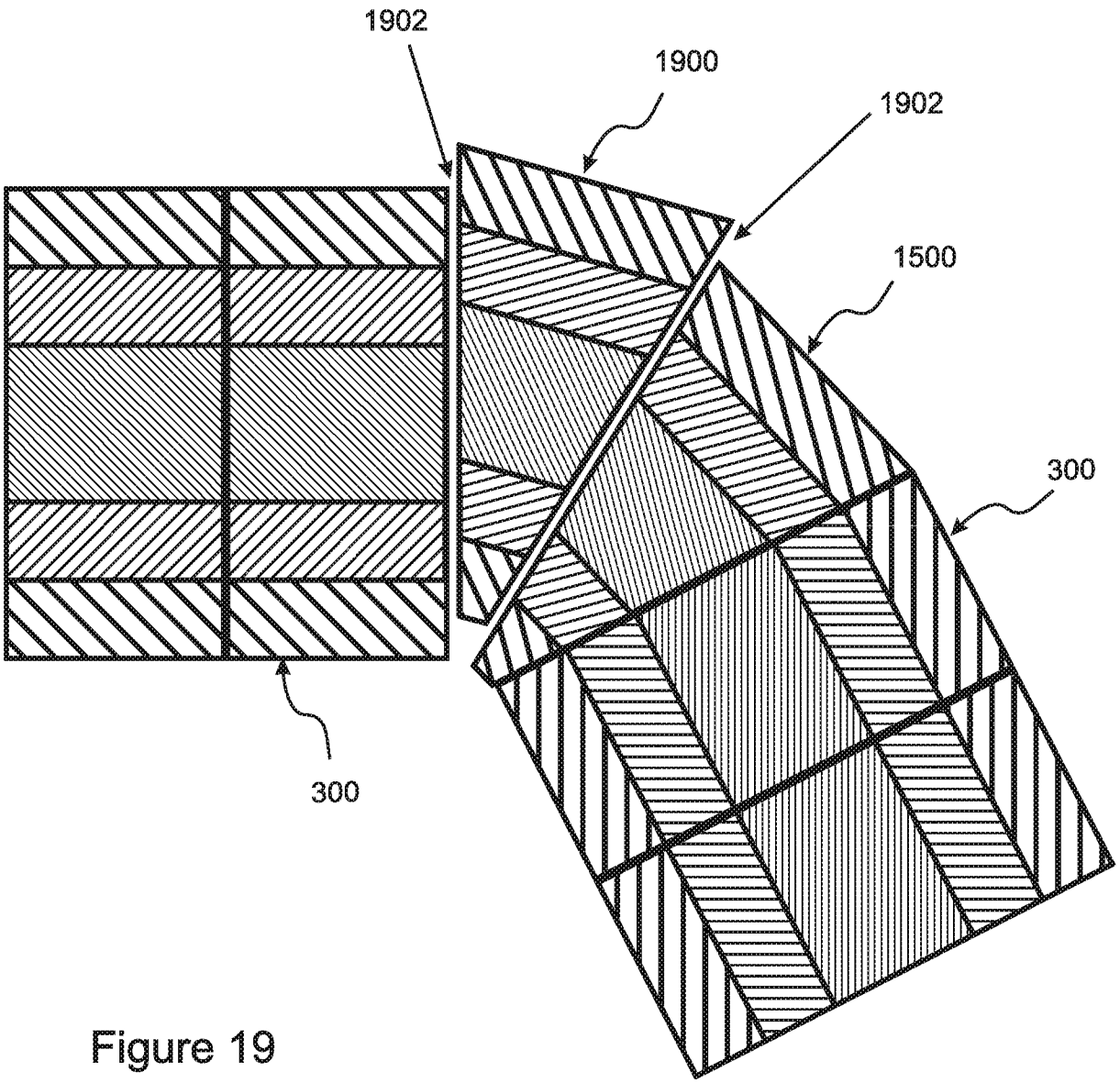
FIG. 19 is a top view of the barrier of FIG. 15B illustrating a gap formed in the barrier by horizontal displacement of a trapezoidal barrier module.

Even when features such as the trench of FIG. 9 and/or the underlying sheet of FIG. 11 are implemented, these measures can be insufficient for resisting horizontal displacement of modules in some cases. In particular, it is notable that displacement of a module even by a small amount relative to its neighbors can lead to leakage of water between the modules. With reference to FIG. 19, this problem can be especially problematic for trapezoidal or wedge-shaped modules because even a slight horizontal displacement of such a wedge-shaped or trapezoidal module 1900 can open up a gap 1902 between the module and neighboring modules 300, 1500, thereby creating an opportunity for water to leak therebetween.

Figure 20:
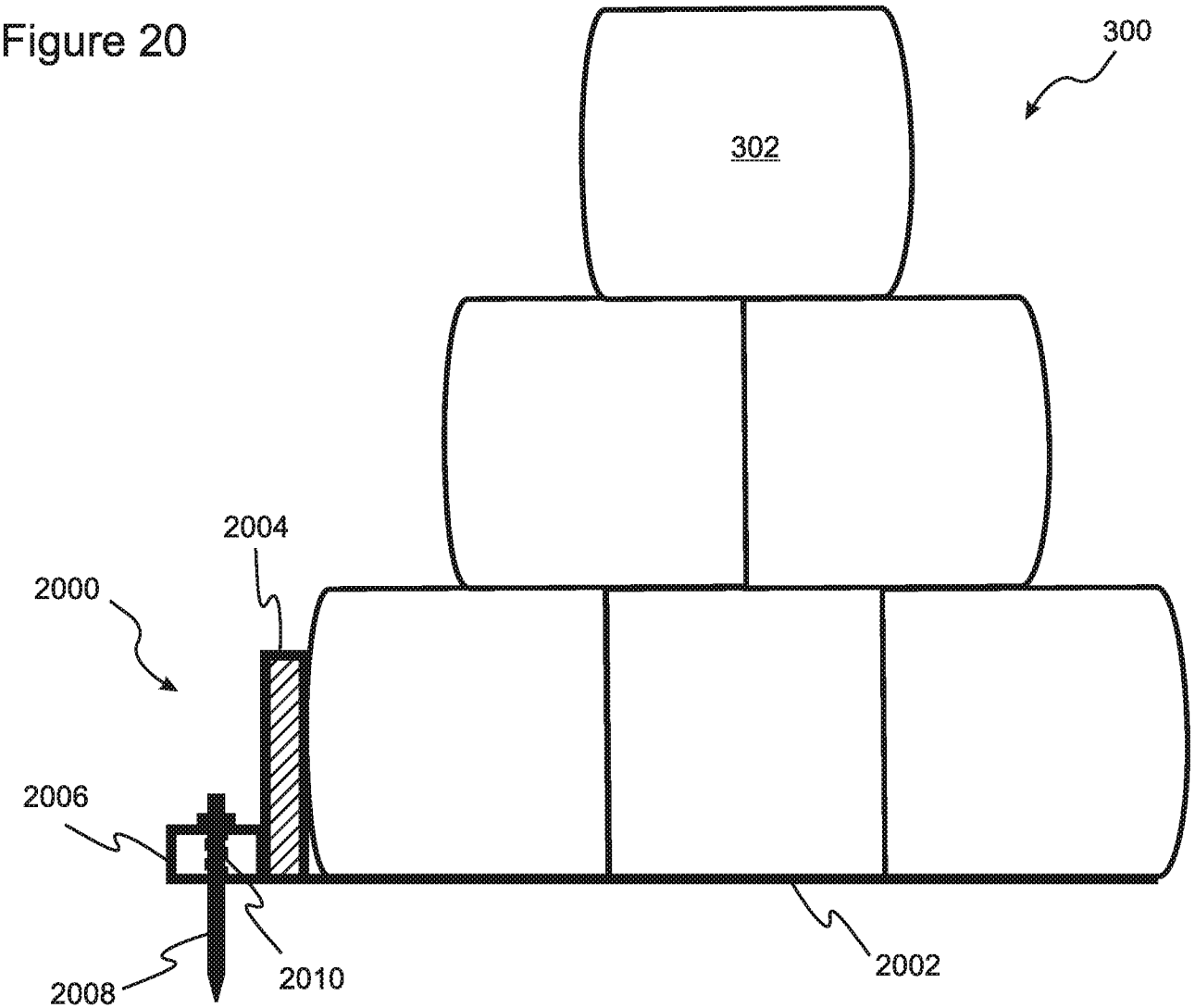
FIG. 20 is a side view of the barrier module of FIG. 3 positioned on an anchoring support base according to an embodiment of the invention.

Accordingly, with reference to FIG. 20, in embodiments the barrier system of the present invention further includes one or more anchoring support bases 2000 that resist rearward horizontal displacement of barrier modules 300. Each anchoring support base 2000 includes an underlying horizontal portion 2002 that extends in front of a vertical portion 2004. The horizontal underlying portion 2000 is configured to be installed beneath the bottom of one or more barrier modules 300, such that the vertical portion 2002 rises behind and abuts the one or more barrier modules 300.

The anchoring support base 2000 further includes an anchoring portion 2006 extending behind the vertical portion 2004 and configured for attachment to the ground by stakes or spikes 2008 driven through openings 2010 provided in the anchoring portion 2006. The vertical 2004 and anchoring 2006 base portions are made from a rigid or semi-rigid material or materials, such as a hard rubber or plastic, and can be formed as a single, monolithic element or as two or more elements that are rigidly fixed to each other, such that the vertical portion 2004 strongly resists any tendency of an abutting barrier module 300 to be horizontally displaced, while the underlying portion 2002 prevents any possible rotation or tipping backward of the vertical portion 2004 due to horizontal pressure from the abutting barrier module 300.

Figure 21A:
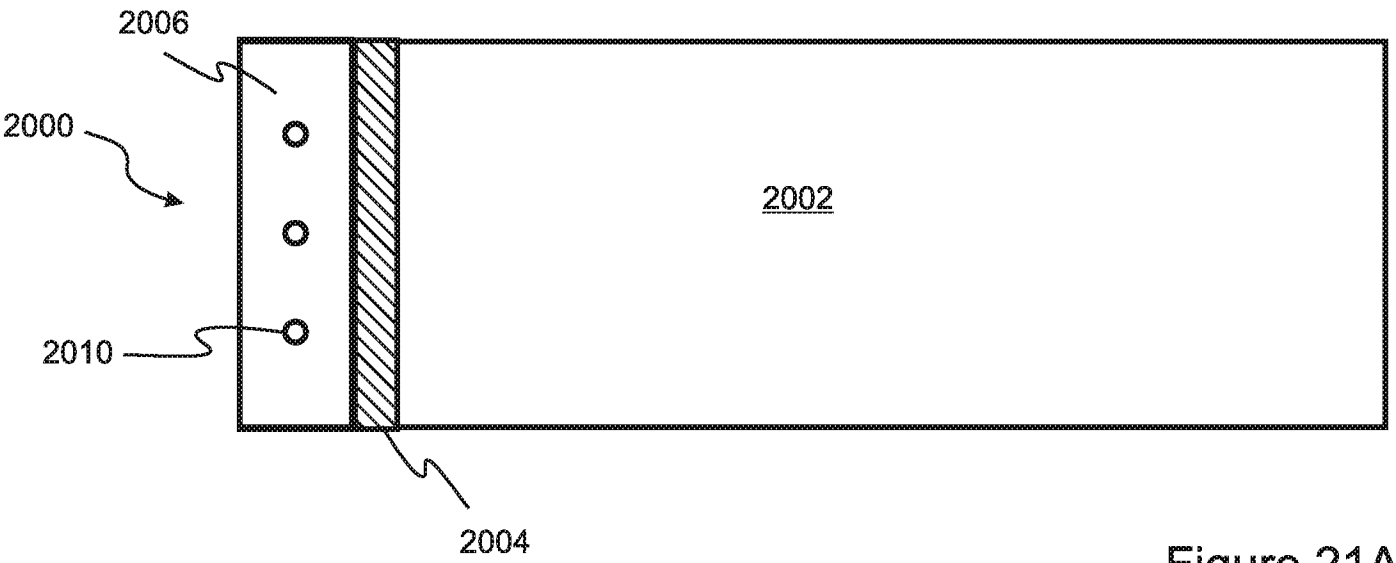
FIG. 21A is a top view of the anchoring support base of FIG. 20, shown without the barrier module.

FIG. 21A is a top view of an anchoring support base configured such that the underlying portion 2002 is configured to extend beneath a barrier module 300 having a rectangular base shape, where the shape of the underlying portion 2002 is substantially identical to the shape of the base of the barrier module 300.

Figure 21B:
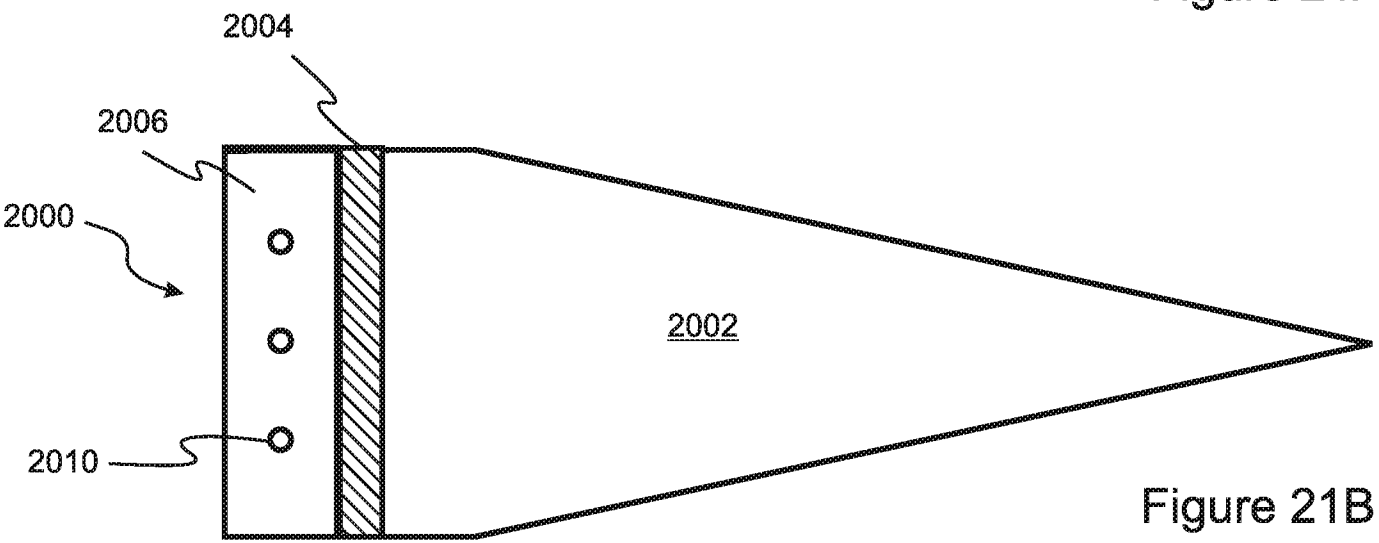
FIG. 21B is a top view of an anchoring support base similar to FIG. 20, but configured with a triangular underlying base portion.

FIG. 21B is a top view of an anchoring support base configured such that the underlying portion 2002 is configured to extend beneath a barrier module 1802 having a triangular base shape, where the shape of the underlying portion 2002 is substantially identical to the shape of the base of the barrier module 1802.

Figure 22:
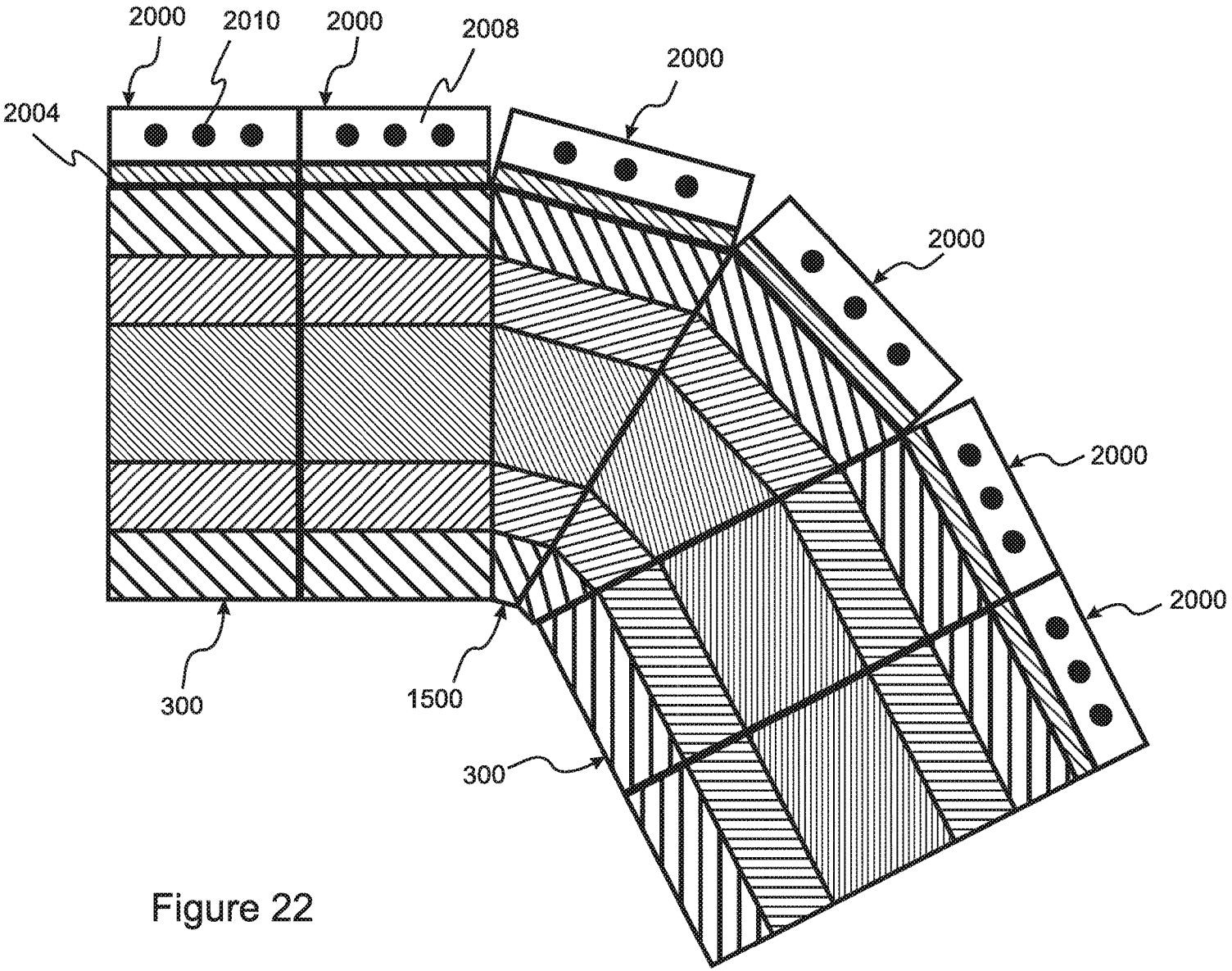
FIG. 22 is a top view of the barrier of FIG. 15B shown with anchoring support bases installed cooperative with each of the barrier modules, according to an embodiment of the present invention.

FIG. 22 is an illustration from above of an embodiment similar to FIG. 15B, showing anchoring base modules 2000 installed cooperatively with each of the barrier modules 300, 1500.

While FIGS. 20 through 22 illustrate anchoring support bases 2000 that conform in shape to the bases of individual barrier modules 300, 1500, 1802, it will be understood that other embodiments include one or more anchoring support bases that do not necessarily conform to the shapes of barrier modules. For example, embodiments include anchoring support bases that extend only partway under a barrier module, and/or anchoring support bases that are narrower that the rear width of a corresponding barrier module. In addition, some embodiments include anchoring base modules that are sufficiently wide to extend beneath more than one barrier module.

It should further be noted that the anchoring base portion need not extend behind the vertical base portion, and that in some embodiments openings are provided in the vertical base portion for insertion therethrough of stakes and/or spikes, so that the vertical base portion is the anchoring base portion. In still other embodiments, the underlying base portion serves as the anchoring base portion, in that openings are provided in the underlying base portion through which stakes and/or spikes can be inserted. In some of these embodiments tops of the stakes and/or spikes are contained within counter bored or countersunk portions of the openings so that the tops of the stakes and/or spikes are substantially flush with an upper surface of the underlying base portion.

Figure 23:
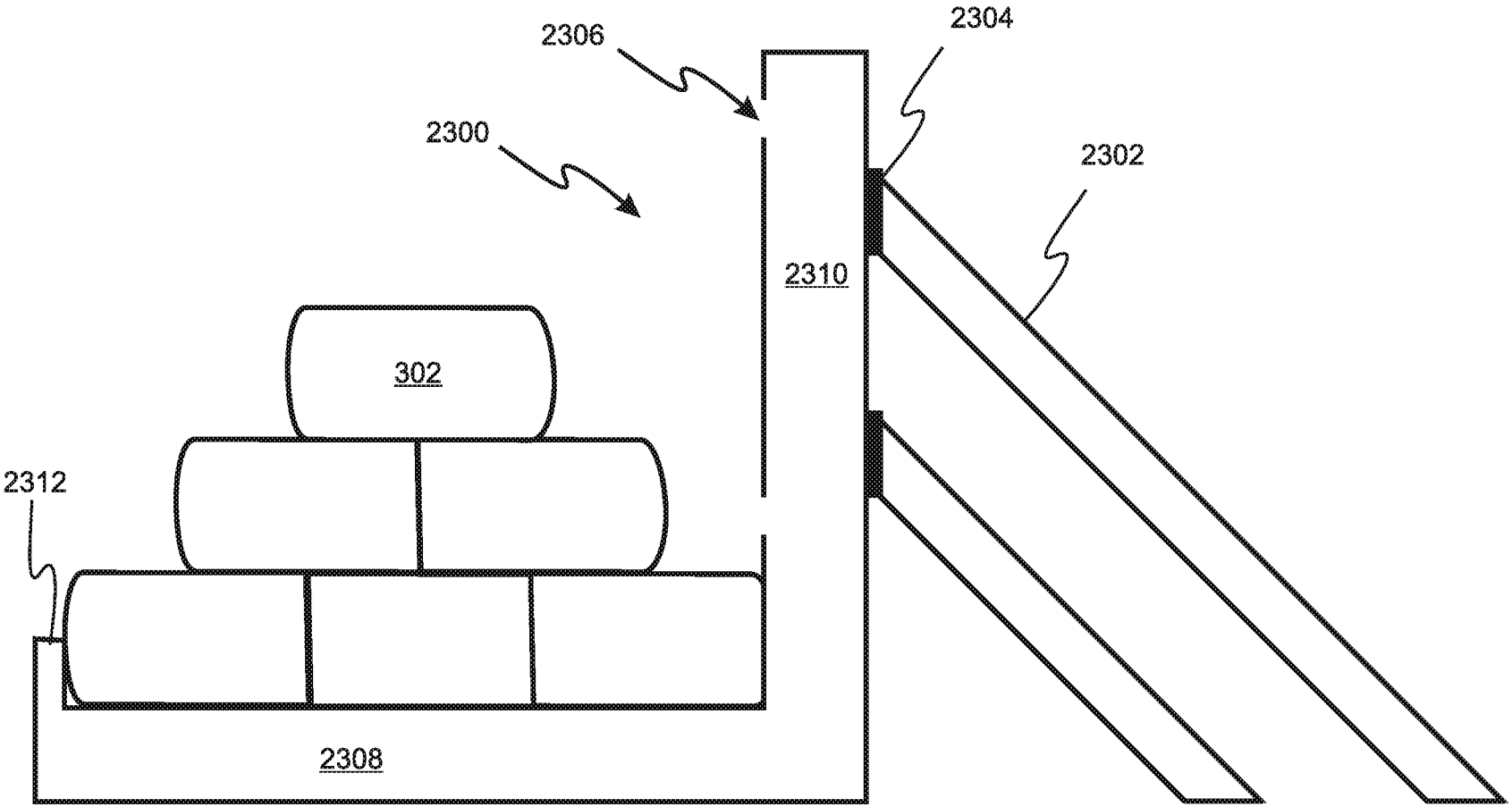
FIG. 23 is a cross-sectional view of an embodiment of the present invention showing an inflatable module installed on a unitary frame that includes a base and a rear wall.

With reference to FIG. 23, in still other embodiments, if even greater resistance to the horizontal pressure of flood waters is required, each barrier module 302 can be placed within a rigid or semi-rigid frame 2300. Each frame 2300 includes a base 2308 upon which the barrier module 302 is placed, and a rear wall 2310 that supports the back side of the barrier module. The frame 2300 comprises a hollow interior surrounded by rigid or semi-rigid panels. At least one brace 2302 is provided that extends from a fitting 2304 provided on the rear panel of the rear wall 2310 to the ground, for example at an angle of approximately 45 degrees. Holes 2306 are provided in the front panel of the rear wall 2310 above the level of the barrier module 302 so that if flood waters surge or splash over the barrier module 302, the water will enter the interior of the frame 2300 and further anchor the frame 2300 and barrier modules 302 against the pressure of flood water. The holes 2306 can also be used to intentionally fill the interior of the frame with locally available water during installation of the barrier system.

Figure 24:
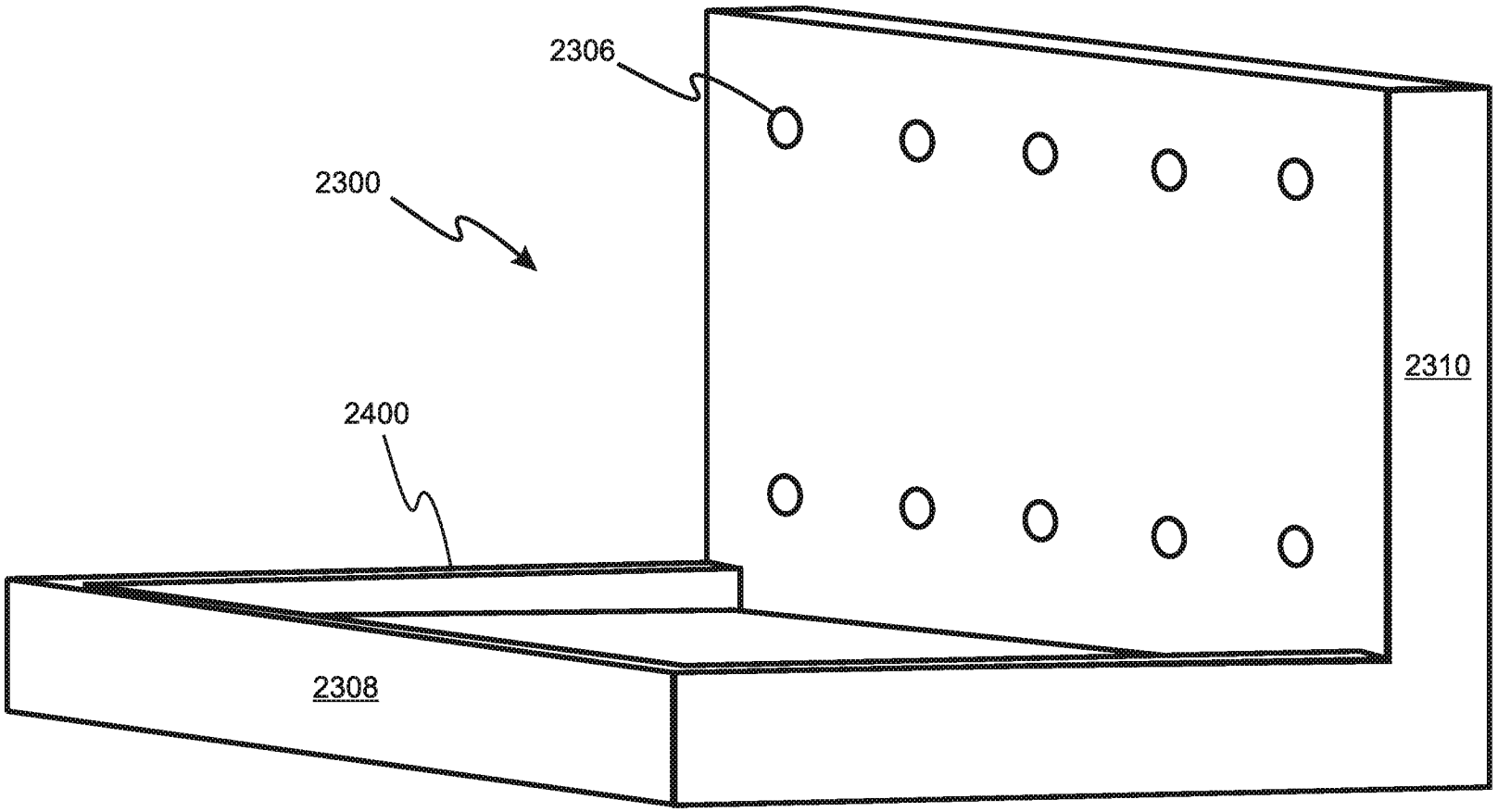
FIG. 24 is a front perspective view of the frame of FIG. 23.

With reference to FIG. 24, the base 2308 can include a raised perimeter 2400 that surrounds the barrier module 302 and helps to ensure that the barrier module is not washed away or otherwise dislodged from the base.

Figure 25:
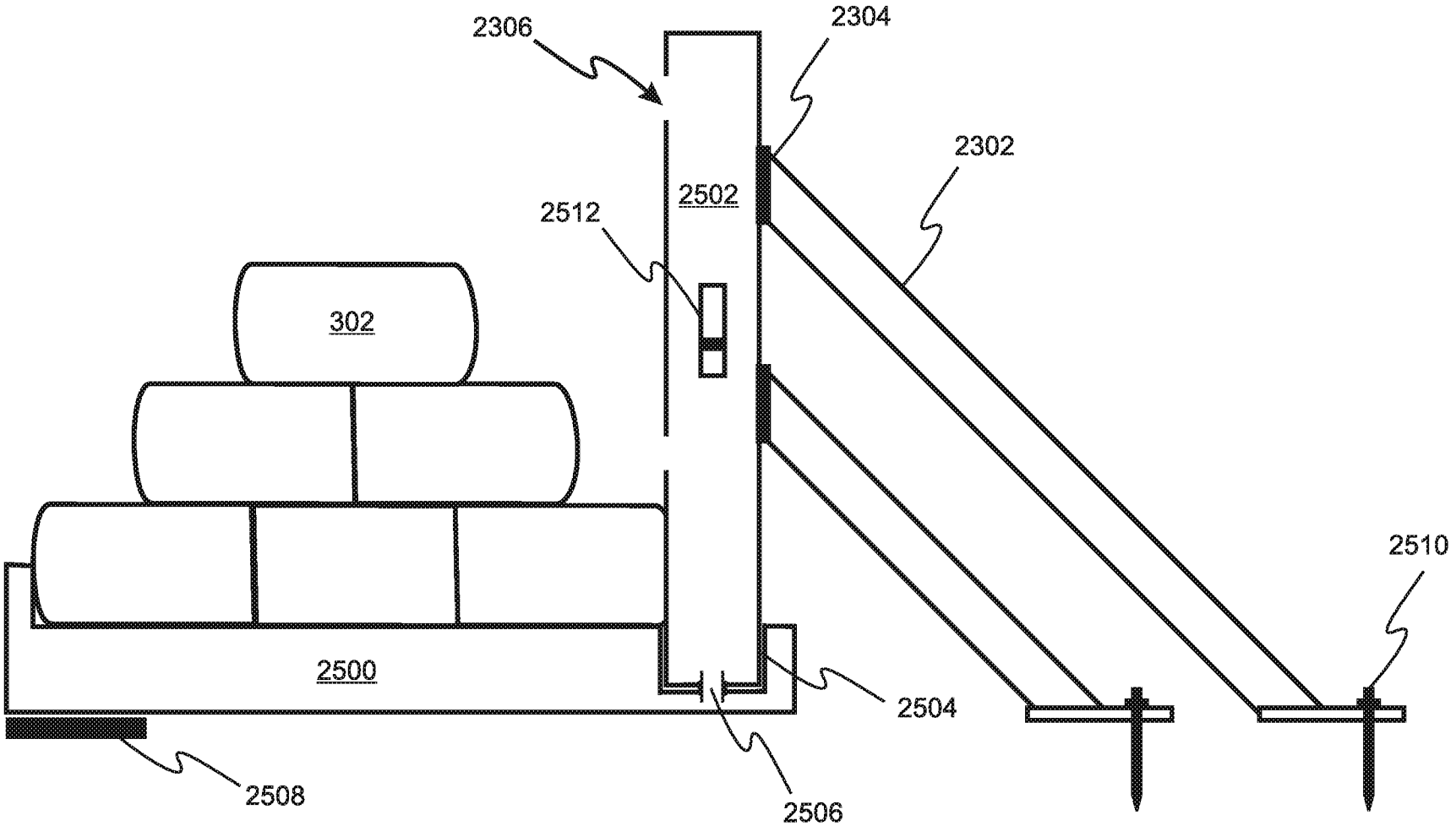
FIG. 25 is a cross sectional view of an embodiment similar to FIG. 23, but wherein the base and rear wall are separate, assembled constructs.

The frame 2300 can be provided as a single construct, as shown in FIGS. 23 and 24, or with reference to FIG. 25 it can be provided as separate base 2500 and rear wall 2502 constructs that are combined during installation. In the embodiment of FIG. 25, a trough 2504 is provided near the rear of the base 2500 into which the bottom of the rear wall 2502 is inserted. In similar embodiments, a "sideways" trough 2504 can be provided in the front of the rear wall 2502 near its lower edge into which a rear portion of the base 2500 can be inserted. A water fitting 2506 can interlink the base 2500 and rear wall 2502, and can form a sealed passage between the hollow interiors of the rear wall 2502 and the base 2500, so that water entering the holes 2306 in the rear wall 2502 can flow into the interior of the base 2500.

In the embodiment of FIG. 23, the distal ends of the braces 2302 are wedged against the ground. In the embodiment of FIG. 25, the braces 2302 are fixed to the ground behind the frame by stakes 2510. The embodiment of FIG. 25 further includes leveling shims 2508 that can be used to level the frame 2300 when placed on uneven terrain. The rear wall 2502 in the embodiment of FIG. 25 further includes a receptacle 2512 on a right side thereof into which a hook (not shown) provided on a left side of a rear wall 2502 of a second frame can be inserted, so that the two frames are coupled together. The receptacle 2512 is enclosed, and does not provide access into the hollow interior of the rear wall 2502.

The foregoing description of the embodiments of the invention has been presented for the purposes of illustration and description. It is not intended to be exhaustive or to limit the invention to the precise form disclosed. Many modifications and variations are possible in light of this disclosure. It is intended that the scope of the invention be limited not by this detailed description, but rather by the claims appended hereto.

What is claimed is:

1. A water-inflatable barrier system comprising:

a first barrier module having:

first module flexible walls forming a first module shell configured to contain water within a first module interior of the first barrier module, said first module shell having a first module front, a first module rear, a substantially rectangular first module bottom, a first module length parallel to the first module front, a first module width perpendicular to the first module front, and a first module cross section that is wider at a first module bottom of the first barrier module than at a first module top of the first barrier module;

a plurality of substantially horizontal and substantially vertical first module partition walls dividing said first module interior into a plurality of adjacent, water-tight first module cells shaped as rectangular parallelepipeds, front and rear first module partition walls of each first module cell being substantially parallel to the first module front of the first module shell, said first module cells being arranged in a plurality of vertically stacked layers that are offset from each other such that none of the first module front and rear partition walls aligns with a first module front or rear partition wall in a vertically adjacent layer;

a first module water inlet in liquid communication with the first module interior; and a plurality of first module passages between the first module cells, said first module passages being configured to allow filling of all of the first module cells with water from the first module water inlet; and a first barrier module support frame, including:

a base portion configured for location on underlying terrain and for placement thereupon of the first barrier module; and a rear wall configured to extend upward behind the first barrier module in abutting relationship therewith when the first barrier module is placed onto the base portion;

said base portion and rear wall having hollow interiors bounded by rigid or semi-rigid panels, at least one hole being provided in a front panel of said rear wall and configured to enable flood water, upon reaching the hole, to flow into the hollow interiors of the rear wall and base portion.

2. The barrier system of claim 1, further comprising at least one brace configured to extend from behind a rear panel of the rear wall to said underlying terrain.

3. The barrier system of claim 1, wherein the base includes a raised perimeter configured, in combination with the rear wall, to surround the first barrier module.

4. The barrier system of claim 1, wherein the base and rear wall are unitary and form a single construct.

5. The barrier system of claim 1, wherein the base and rear wall are separate constructs that can be assembled to form the first barrier module support frame.

6. The barrier system of claim 5, wherein a trough is provided in one of the base and rear wall into which a portion of the other of the base and rear wall can be inserted during assembly of the first barrier module support frame.

7. The barrier system of claim 5, further comprising a fitting configured to extend between the base and rear wall when they are assembled, and to provide liquid communication between the base and rear wall.

8. The barrier system of claim 1, wherein the barrier system further comprises a second barrier module and a second barrier module support frame, sides of said first and second barrier module support frames being configured for mutual coupling together of the first and second barrier module support frames.

9. The barrier system of claim 2, wherein at least one of the braces includes an anchor configured to fix a distal end of the brace to the underlying terrain.

10. The barrier system of claim 9, wherein the anchor includes a spike configured for insertion into the underlying terrain.

11. A method of constructing a barrier assembly, the method comprising:

providing a water inflatable barrier system according to claim 1;

placing the first barrier module support frame at a desired location;

placing the first barrier module onto the base of the first barrier module support frame; and inflating the first barrier module with water.

12. The method of claim 11, further comprising fixing a proximal end of a brace to a rear panel of the rear wall of the first barrier module support frame, and fixing a distal end of the brace to the underlying terrain.

13. The method of claim 12, wherein fixing the distal end of the brace to the underlying terrain includes inserting a stake into the underlying terrain.

14. The method of claim 11, further comprising filling the hollow interior of the first barrier module support frame with water.

15. The method of claim 11, wherein the base and rear wall of the first barrier module support frame are separate constructs, and the method further includes assembling the base and rear wall together to form the first barrier module support frame.

16. The method of claim 11, further comprising inflating the first barrier module with air before placement thereof onto the base, and wherein inflating the first barrier module with water includes removal of said air from said first barrier module.

* * * * *